United States Patent [19]

Moritugu et al.

[11] Patent Number: 4,562,823

[45] Date of Patent: Jan. 7, 1986

[54] IGNITION DEVICE FOR INTERNAL COMBUSTION ENGINE

[75] Inventors: Mitiyasu Moritugu, Okazaki; Hisasi Kawai, Toyohashi; Norihito Tokura, Aichi, all of Japan

[73] Assignee: Nippon Soken, Inc., Nishio, Japan

[21] Appl. No.: 630,726

[22] Filed: Jul. 13, 1984

[30] Foreign Application Priority Data

| | | | |
|---|---|---|---|
| Jul. 15, 1983 | [JP] | Japan | 58-127735 |
| Dec. 27, 1983 | [JP] | Japan | 58-251574 |
| Jan. 10, 1984 | [JP] | Japan | 59-3284 |
| Jan. 17, 1984 | [JP] | Japan | 59-6908 |

[51] Int. Cl.[4] ..... F02P 9/00

[52] U.S. Cl. ..... 123/620; 123/621; 123/596; 123/622

[58] Field of Search ..... 123/621, 620, 596, 634, 123/622

[56] References Cited

U.S. PATENT DOCUMENTS

| | | | |
|---|---|---|---|
| 2,904,763 | 9/1959 | Harruff | 123/634 |
| 3,885,541 | 5/1975 | Hufton | 123/621 |
| 3,893,438 | 7/1975 | Dienor | 123/621 |
| 4,083,347 | 4/1978 | Grather et al. | 123/634 |
| 4,349,008 | 9/1982 | Wainwright | 123/621 |
| 4,448,182 | 5/1984 | Doyama et al. | 123/621 |
| 4,463,744 | 8/1984 | Tanaka et al. | 123/634 |

*Primary Examiner*—Raymond A. Nelli

*Attorney, Agent, or Firm*—Cushman, Darby & Cushman

[57] ABSTRACT

An ignition device for an internal combustion engine has a DC power source, first and second switching elements, a control signal generator for the switching elements, an ignition coil, and spark gaps. A first part of a primary coil of the ignition coil, a capacitor, the DC power source, and the first switching element form a closed circuit. A second part of the primary coil and the second switching element form another closed circuit. The signal generator generates ON signals for alternately turning on the first and second switching signals at predetermined timings based on an ignition command signal. The ignition performance of this ignition device for an internal combustion engine is improved.

16 Claims, 29 Drawing Figures

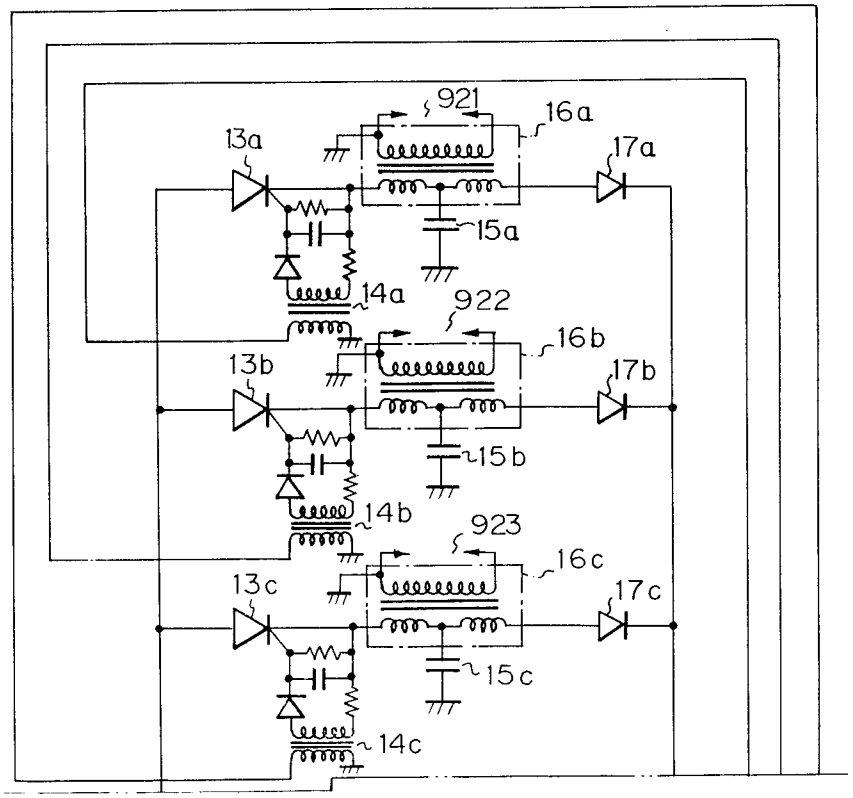
Fig. 8A
Fig. 8
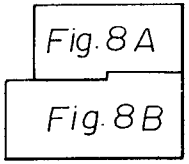

7
75
7502
S(A)
7517
QD U/D
RAB C D L
Ci
7516
7514
7515
7518
7526
7525
7524
7523
7522
7521
7519
7513
7512
7511
7501
741
+Tr
-Tr
Q
R
V

| Fig. 15A | Fig. 15B |
|---|---|

IGNITION DEVICE FOR INTERNAL COMBUSTION ENGINE

BACKGROUND OF THE INVENTION

1. Field of the Invention

The present invention relates to a spark ignition type ignition device for an internal combustion engine.

2. Description of the Prior Art

In a conventional ignition device for an internal combusion engine, the strength of the spark decreases during high-speed operation and ignition failure tends to occur since spark plugs spark only once per ignition cycle at each cylinder. In particular, in a capacitive—discharge ignition (CDI) device, the spark may be weak, i.e., rapidly extinguished, during engine start or low-speed operation, which will also result in ignition failure.

SUMMARY OF THE INVENTION

It is an object of the present invention to provide an ignition device for an internal combustion engine wherein a plurality of sparks are continuously generated for extremely short periods during a suitable time interval, the strength of the spark is sufficient during high-speed operation, the spark sustaining time is sufficiently prolonged, preventing ignition failure and improving ignition performance, and damage to switching elements is prevented so that the switching elements operate safely and reliably.

In accordance with a fundamental aspect of the present invention, there is provided an ignition device for an internal combustion engine, including: a DC power source for generating a DC voltage; an ignition coil having a primary coil and a secondary coil, at least the primary coil being divided into first and second parts by an intermediate tap; a spark gap connected to the secondary coil; a capacitor connected to the intermediate tap of the primary coil; a first switching element for forming a first closed circuit together with the first part of the primary coil, the capacitor and the DC power source; a second switching element for forming a second closed circuit together with the second part of the primary coil and the capacitor; and a signal generating circuit, responsive to an ignition command signal, for generating ON signals so as to alternately turn on the first and second switching elements at predetermined timings.

In accordance with another aspect of the present invention, there is provided an ignition device for an internal combustion engine, including: a DC power source for generating a DC voltage; an ignition coil having first and second primary coils and first and second secondary coils; a plurality of spark plugs connected to the first and second secondary coils; a capacitor connected to a primary coil intermediate terminal, one ends of the first and second primary coils being connected at the intermediate terminal so that the first and second primary coils generate magnetic fields in the same direction upon being energized; a first switching element for forming a first closed circuit together with the first primary coil, the capacitor, and the DC power source; a second switching element for forming a second closed circuit together with the second primary coil and the capacitor; and a signal generating circuit, responsive to an ignition command signal, for generating ON signals so as to alternately turn on the first and second switching elements at predetermined timings.

In accordance with a further aspect of the present invention, there is provided an ignition device for an internal combustion engine, including: a DC power source for generating a DC voltage; an ignition coil having first and second primary coils and a secondary coil, the first and second primary coils partially overlapping each other to be magnetically strongly coupled; a spark plug connected to the secondary coil; a capacitor connected to a primary coil intermediate terminal, one ends of the first and second primary coils being connected at the intermediate terminal so that the first and second primary coils generate magnetic fields in the same direction upon being energized; a first switching element for forming a first closed circuit together with the first primary coil and the DC power source; a second switching element for forming a second closed circuit together with the second primary coil and the capacitor; and a signal generator, responsive to an ignition command signal, for generating ON signals so as to alternately turn on the first and second switching elements at predetermined timings.

BRIEF DESCRIPTION OF THE DRAWINGS

FIGS. 8, 8A and 8B are a circuit diagram of an ignition device for an internal combustion engine according to another embodiment of the present invention;

DESCRIPTION OF THE PREFERRED EMBODIMENTS

Figure 1:
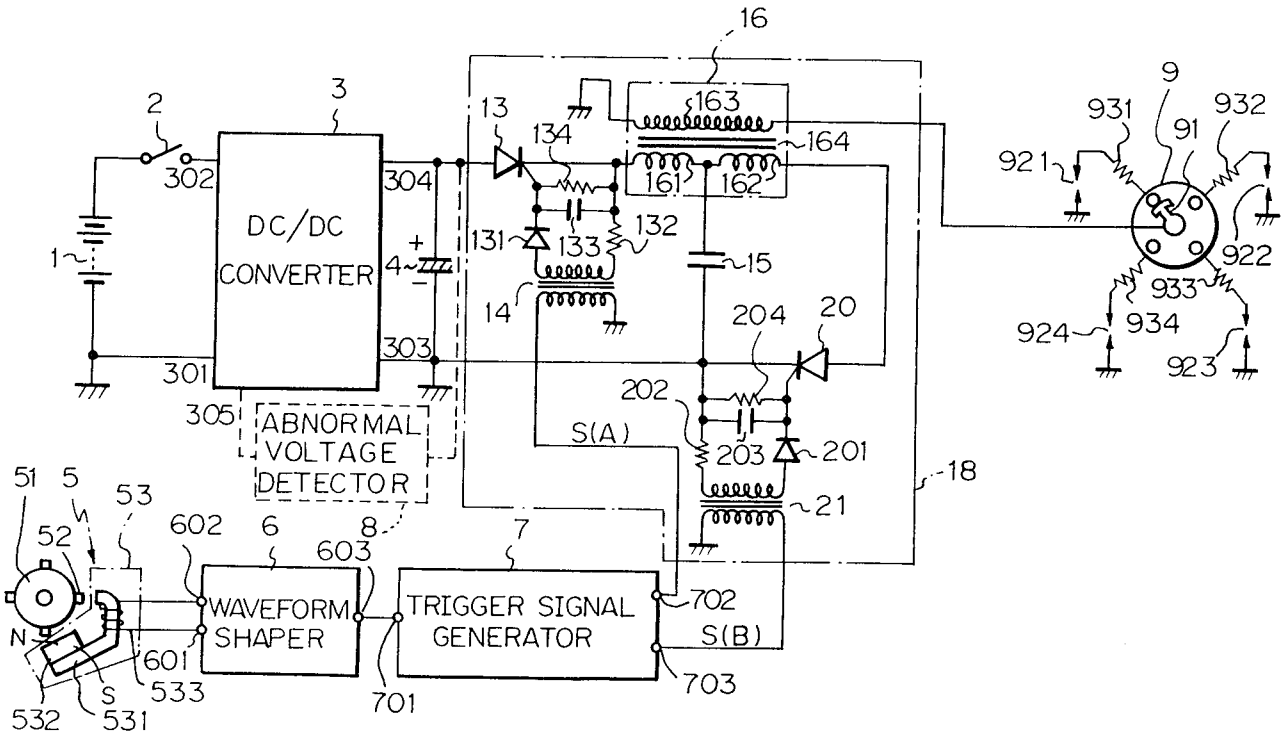
FIG. 1 is a circuit diagram of an ignition device for an internal combustion engine according to an embodiment of the present invention.

FIG. 1 shows an ignition device for an internal combustion engine according to an embodiment of the present invention.

Referring to FIG. 1, a DC power source 1 comprising a battery supplies a DC voltage to a DC/DC converter 3 through an engine key switch 2. The engine key switch 2 is closed when the engine is operative and is open when the engine is nonoperative. The DC/DC converter 3 converts the DC voltage from the DC power source 1, e.g., a voltage of 12 V, to a DC voltage of about 200 V. The DC/DC converter 3 boosts the input voltage through a transformer, by self-excitation of a transistor, and then rectifies the boosted voltage to provide a high or hot DC voltage. Details of the DC/DC converter 3 in the device shown in FIG. 1 are shown in FIG. 2.

Figure 2:
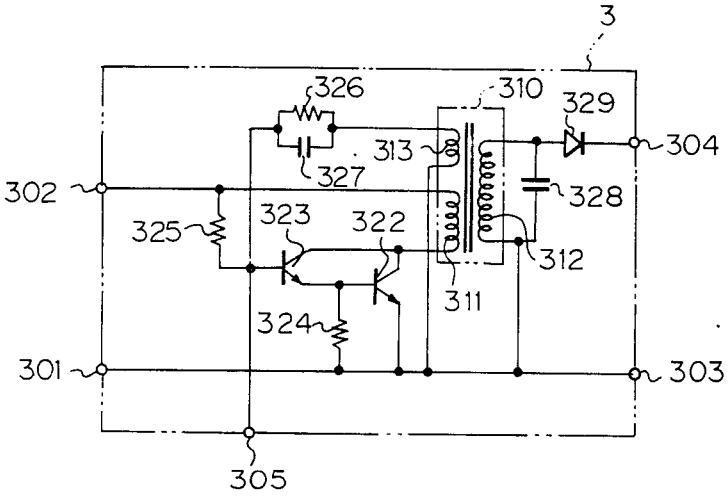
FIG. 2 is a circuit diagram of the configuration of a DC/DC converter in the device shown in FIG. 1.

Referring to FIG. 2, a transformer 310 has a primary coil 311, a secondary coil 312, and a tertiary coil 313. The turn ratio of the primary coil 311 and the secondary coil 312 is set to be about 20. A current supplied from the DC power source 1 through a terminal 302 is switched by Darlington-connected transistors 322 and 323. Then, a voltage boosted to about 200 V in accordance with the above-mentioned turn ratio is generated in the secondary coil 312 and is rectified by a diode 329 to appear at a terminal 304. A capacitor 328 switches the DC/DC converter 3 at a resonance frequency which is determined by the capacitor 328 and the secondary coil 312. The tertiary coil 313 oscillates the transistor 323 by positive feedback to the base thereof. Resistors 325 and 326 and a capacitor 327 serve to stabilize the bias voltage applied to the base of the transistor 323. A resistor 324 is an input resistor of the transistor 322. A terminal 305 controls the operation of the DC/DC converter 3 in accordance with a voltage applied thereto. The voltage applied to the terminal 305 is turned on or off in accordance with an output signal from the abnormal voltage detector 8, to be described later.

Referring back to FIG. 1, a capacitor 4 smooths an output voltage from the DC/DC converter 3 and stores the smoothed voltage in order to supply a high transient current, to be described later.

An ignition timing detector 5 has a signal rotor 51 and a pickup 53. The signal rotor 51 consists of a magnetic material and detects the ignition timing. The signal rotor 51 has a number of projections 52 corresponding to the number of cylinders and is mounted on a distributor shaft (not shown) rotating at a frequency one half that of the engine speed. The pickup 53 also detects the ignition timing and consists of a magnetic core 531 of a magnetic material, a coil 533 wound around the magnetic core 531, and a permanent magnet 532. When each projection 52 of the signal rotor 51 opposes the magnetic core 531 of the pickup 53, a closed magnetic circuit is formed.

The relationship between the phases of the signal rotor 51 and the pickup 53 change suitably in accordance with the engine speed, load and the like so as to obtain an optimal ignition timing.

Figure 3:
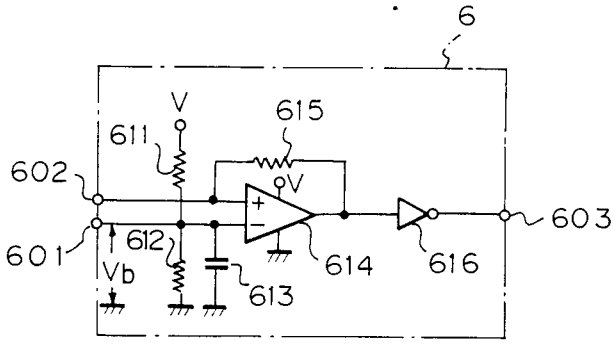
FIG. 3 is a circuit diagram of a waveform shaper in the device shown in FIG. 1.

A waveform shaper 6 shapes the waveform of an output signal from the pickup 53 and produces a "1" level signal (referred to as "1" for brevity hereinafter) corresponding to the ignition timing. FIG. 3 shows details of the waveform shaper 6 in the device shown in FIG. 1. A bias voltage $V_b$ set by resistors 611 and 612 and a capacitor 613 is applied to one end of the coil 533 of the pickup 53 through a terminal 601. The bias voltage $V_b$ is also supplied as a reference voltage to an inverting input terminal of a comparator 614. The non-inverting input terminal of the comparator 614 is connected to the other end of the coil 533 through a terminal 602. The comparator 614 produces a "1" signal or a "0" level signal (referred to as "0" for brevity hereinafter) in accordance with the sign of the voltage generated in the coil 533.

The output from the comparator 614 is positively fed back to the non-inverting input terminal thereof through a resistor 615. This positive feedback circuit functions as a Schmitt trigger circuit with hysteresis characteristics and therefore can prevent erratic circuit operation due to noise input. The output from the comparator 614 is inverted by an inverter 616 and the inverted signal is produced as an ignition timing signal from a terminal 603.

Figure 4:
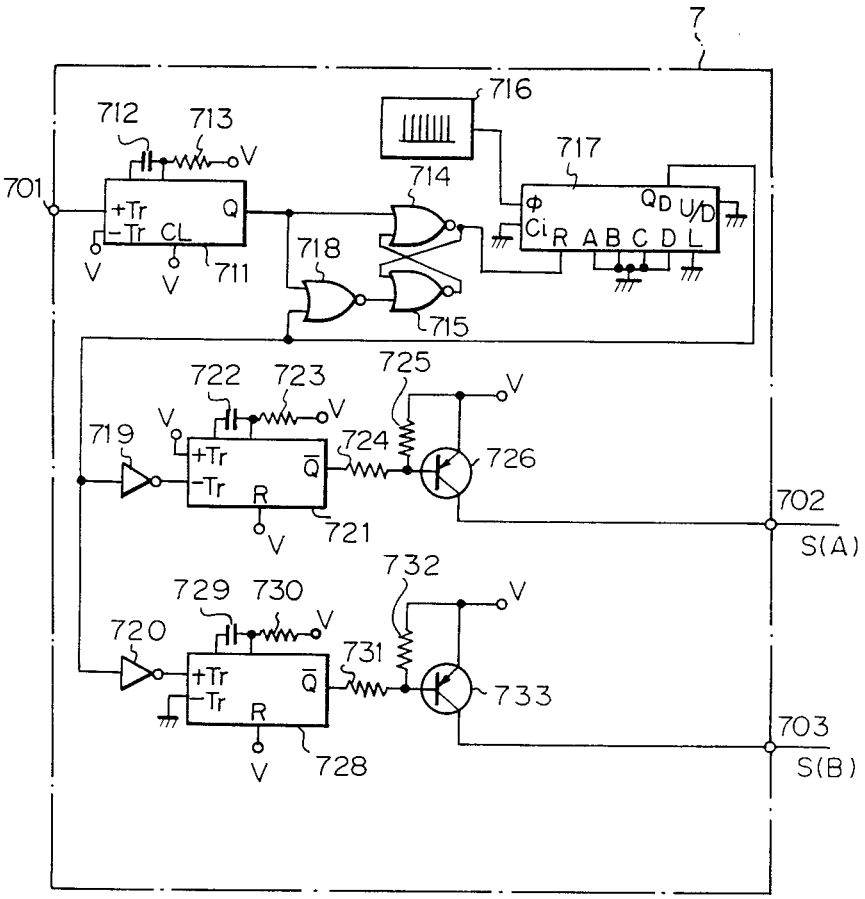
FIG. 4 is a circuit diagram of a trigger signal generator in the device shown in FIG. 1.

Based on the ignition timing signal from the waveform shaper 6, a trigger signal generator 7 produces two trigger signals S(A) and S(B) which have phases shifted by 180° from each other and which are repeated at short periods within a predetermined time period. FIG. 4 shows details of the trigger signal generator 7 in the device shown in FIG. 1. The ignition timing signal from the waveform shaper 6 is supplied to a one-shot multivibrator 711 through a terminal 701. The one-shot multivibrator 711 is triggered at the leading edge of the ignition timing signal and produces a "1" signal from an output terminal Q for a time period (e.g., 2 msec) determined by a capacitor 712 and a resistor 713.

NOR gates 714 and 715 are connected to constitute an R-S flip-flop. When the output signal from the one-shot multivibrator 711 is "1", the output signal from the NOR gate 714 is "0" and that from the NOR gate 715 is "1". A 4-bit binary presettable up/down counter 717 receives an output from the NOR gate 714 at its reset terminal R. When the output signal from the NOR gate 714 is "0", the counter 717 starts counting. When the output signal from the NOR gate 714 goes to "1", the counter 717 is reset. The counter 717 is set in the down count mode and the preset function is not used.

A clock generator 716 continuously generates clock signals of a frequency of, for example, about 80 kHz. The clock signals generated by the clock generator 716 are supplied to a clock input terminal Ø of the counter 717. One input terminal of a NOR gate 718 is connected to the output terminal of the one-shot multivibrator 711, and the other input terminal thereof is connected to an output terminal $Q_D$ as a 1/16 frequency-division output terminal of the counter 717. When the two input signals are "0", the output signal from the NOR gate 718 is "1". The output signal from the NOR gate 718 is supplied to the NOR gate 715 to invert the R-S flip-flop consisting of the NOR gates 714 and 715.

The $Q_D$ output from the counter 717 is also supplied to one-shot multivibrators 721 and 728 through inverter buffers 719 and 720, respectively. The one-shot multivibrator 721 is triggered at the trailing edge of the output signal from the inverter buffer 719 and produces a signal "0" from an output terminal $\overline{Q}$ for a time period (e.g., 5 μsec) determined by a capacitor 722 and a resistor 723. The signal "0" from the one-shot multivibrator 721 is supplied to the base of a transistor 726 through resistors 724 and 725. When the $\overline{Q}$ output from the one-shot multivibrator 721 is "0", the transistor 726 is turned on and generates a trigger signal S(A) "1" at its collector or terminal 702.

The one-shot multivibrator 728 is triggered at the leading edge of the output signal from the inverter buffer 720 and produces a signal "0" at an output terminal $\overline{Q}$ for a time period (e.g., 5 μsec) determined by a capacitor 729 and a resistor 730. This signal "0" is supplied to the base of a transistor 733 through resistors 731 and 732. When the $\overline{Q}$ terminal of the one-shot multivibrator 728 is "0", the transistor 733 is turned on and produces a trigger signal S(B) "1" at its collector or terminal 703.

Referring back to FIG. 1, the anode of a thyristor 13 is connected to the positive terminal of the capacitor 4, and the cathode thereof is connected to one end of a primary coil 161 of an ignition coil 16. The trigger signal S(A) from the trigger signal generator 7 is applied to the gate of the thyristor 13 through an insulating pulse transformer 14 and through a noise preventing circuit consisting of a diode 131, a resistor 132, a capacitor 133, and a resistor 134. A resonance capacitor 15 is connected to the intermediate tap between the primary coil 161 and another primary coil 162 of the ignition coil 16. The thyristor 13 forms a closed circuit consisting of the capacitor 4, the thyristor 13, the primary coil 161, and the resonance capacitor 15.

The anode of a thyristor 20 is connected to one end of the primary coil 162, and the cathode thereof is connected to one end (GND) of the resonance capacitor 15. The trigger signal S(B) from the trigger pulse generator is supplied to the gate of the thyristor 20 through a pulse transformer 21 and a noise preventing circuit consisting of a diode 201, resistors 202 and 204, and a capacitor 203. The thyristor 20 forms another closed circuit consisting of the primary coil 162, the thyristor 20, and the resonance capacitor 15.

The ignition coil 16 consists of the primary coils 161 and 162, the secondary coil 163, and a core 164. The turn ratio of the primary coils 161 and 162 to the secondary coil 163 is set to be about 100 to 200, and the primary coils 161 and 162 are wound in the same direction. The primary coils 161 and 162 and the secondary coil 163 are magnetically coupled through the core 164. A voltage generated in the primary coils 161 and 162 is boosted and the boosted voltage is generated from the secondary coil 163. One end of the secondary coil 163 is grounded (GND), and the other end thereof is connected to the center electrode of a distributor 9 for distributing the boosted hot voltage to each cylinder.

The distributor 9 is of a known configuration. More specifically, when a distributing rotor 91 rotates together with a shaft rotating at a frequency one half that of the engine speed, the distributor 9 sequentially applies a high voltage to predetermined spark gaps 921, 922, 923, and 924 of the cylinders through high-tension cords 931, 932, 933, and 934.

The following semiconductor devices are used in the device shown in FIG. 1:

| | |
|---|---|
| One-shot multivibrator 711 | TC4528BP (Toshiba) |
| NOR gates 714, 715, 718 | TC4001BP (Toshiba) |
| Up/down counter 717 | TC4516BP (Toshiba) |
| Inverters 719, 720 | TC4049BP (Toshiba) |
| One-shot multivibrators 721, 728 | 74LS221 (Texas Instruments) |

The mode of operation of the device shown in FIG. 1 will be described.

Figure 5:
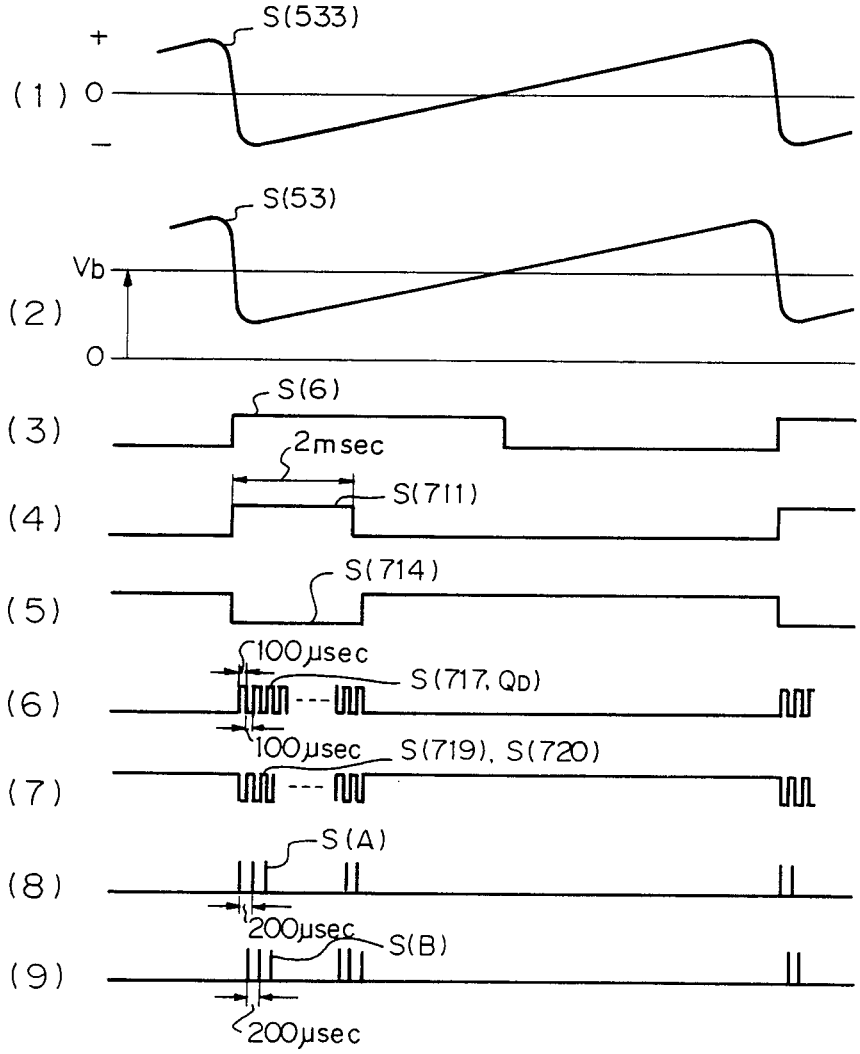
FIG. 5 is a timing chart of signals at various points in the device shown in FIG. 1.

FIG. 5 is a timing chart of signals at various points of the device shown in FIG. 1. FIG. 5(1) shows a voltage S(533) generated in the coil 533; FIG. 5(2) shows an output voltage S(53) of the pickup 53; FIG. 5(3) shows an ignition timing signal S(6) as an output from the waveform shaper 6; FIG. 5(4) shows an ignition time signal S(711) as an output from the one-shot multivibrator 711; FIG. 5(5) shows an output signal S(714) from the NOR gate 714; FIG. 5(6) shows an output signal S(717, $Q_D$) from the counter 717; FIG. 5(7) shows output signals S(719) and S(720) from the inverter buffers 719 and 720; FIG. 5(8) shows the trigger signal S(A); and FIG. 5(9) shows the trigger signal S(B).

When the engine key switch 2 is turned on, a DC voltage of +12 V is supplied from the DC power source 1 to the DC/DC converter 3 which then produces a voltage of +200 V. The voltage of +200 V is constantly stored on the capacitor 4.

As the engine rotates, the signal rotor 51 rotates, and a voltage having the waveform shown in FIG. 5(1) is generated in the coil 533 of the pickup 53. A timing at which the sign of this voltage changes from positive to negative is the ignition timing. Since the coil 533 is biased by the bias voltage $V_b$, the output voltage from the pickup 53 is a sum of the signal shown in FIG. 5(1) and the bias voltage $V_b$, as shown in FIG. 5(2). This signal is shaped by the waveform shaper 6 to provide a signal which rises to "1" at the ignition timing, as shown in FIG. 5(3).

The output signal from the waveform shaper 6 is supplied to the trigger signal generator 7. When the output signal from the waveform shaper 6 rises, the one-shot multivibrator 711 is triggered to generate an ignition timing signal having a pulse width of about 2 msec, as shown in FIG. 5(4). The ignition timing signal from the one-shot multivibrator 711 is supplied to the NOR gate 714 to invert the R-S flip-flop consisting of the NOR gates 714 and 715. Then the output signal from the NOR gate 714 goes to "0", as shown in FIG. 5(5).

The output signal from the NOR gate 714 is supplied to the reset input terminal R of the counter 717. When the signal received at the reset input terminal R is "0", the counter 717 is released from the reset state. The counter 717 then starts counting clocks generated at a frequency of about 80 kHz from the clock generator 716. The counter 717 is a 4-bit binary counter and is set in the down-count mode, as described above. Therefore, at the leading edge of the first clock signal, the count of the counter 717 changes from 0 to 15. In other words, the $Q_D$ output from the counter 717 changes from "0" to "1". Thereafter, every time the clock signal is received, the counter 717 counts down periodically in the order of 0, 15, 14, . . . , 2, 1, 0, 15, . . . and so on. At this time, the $Q_D$ output as a 1/16 frequency-division output is "1" when the count of the counter 717 falls within the range of 8 to 15. Thus, the counter 717 generates a square wave having a duty ratio of about 50% and a frequency 1/16 that of the clock signals. The pulse shown in FIG. 5(6) has a pulse width of 100 μsec and a pulse separation of 100 μsec.

Approximately 2 msec after the ignition timing signal rises, the input signal to the NOR gate 714 becomes "0". If the counter 717 is immediately reset in this case, the time duration of the immediately preceding $Q_D$ output of "1" becomes short, and commutation of the thyristors to be described later cannot be performed satisfactorily. As a measure against this, the outputs from the one-shot multivibrator 711 and the counter 717 are supplied to the NOR gate 718. Only when the $Q_D$ output is "0" is the output signal from the NOR gate 718 "1", thus inverting the flip-flop consisting of the NOR gates 714 and 715. The output signal from the NOR gate 714 then becomes "1", and the counter 717 is reset.

As described above, the $Q_D$ output has, at least during the ignition period, an integer number of square pulses having a frequency (5 kHz) 1/16 that of the clock signals within a delay time of one period (1.25 μsec) of the clock signal from the ignition timing signal. The $Q_D$ signal is inverted by the inverter buffers 719 and 720 to obtain a signal as shown in FIG. 5(7).

Upon being triggered at the trailing edge of the output from the inverter buffer 719, the one-shot multivibrator 721 generates a pulse of about 5 μsec to turn on the transistor 726 and to supply the trigger signal S(A) shown in FIG. 5(8) to the terminal 702. When triggered by the leading edge of the output signal from the inverter buffer 720, the one-shot multivibrator 728 generates a pulse of about 5 μsec to turn on the transistor 733 and to supply the trigger signal S(B) shown in FIG. 5(9) to the terminal 703. Thus, the trigger signals S(A) and S(B) are signals which have phases shifted from each other by 180°, a period of 200 μsec, and a pulse width of 5 μsec.

Figure 6:
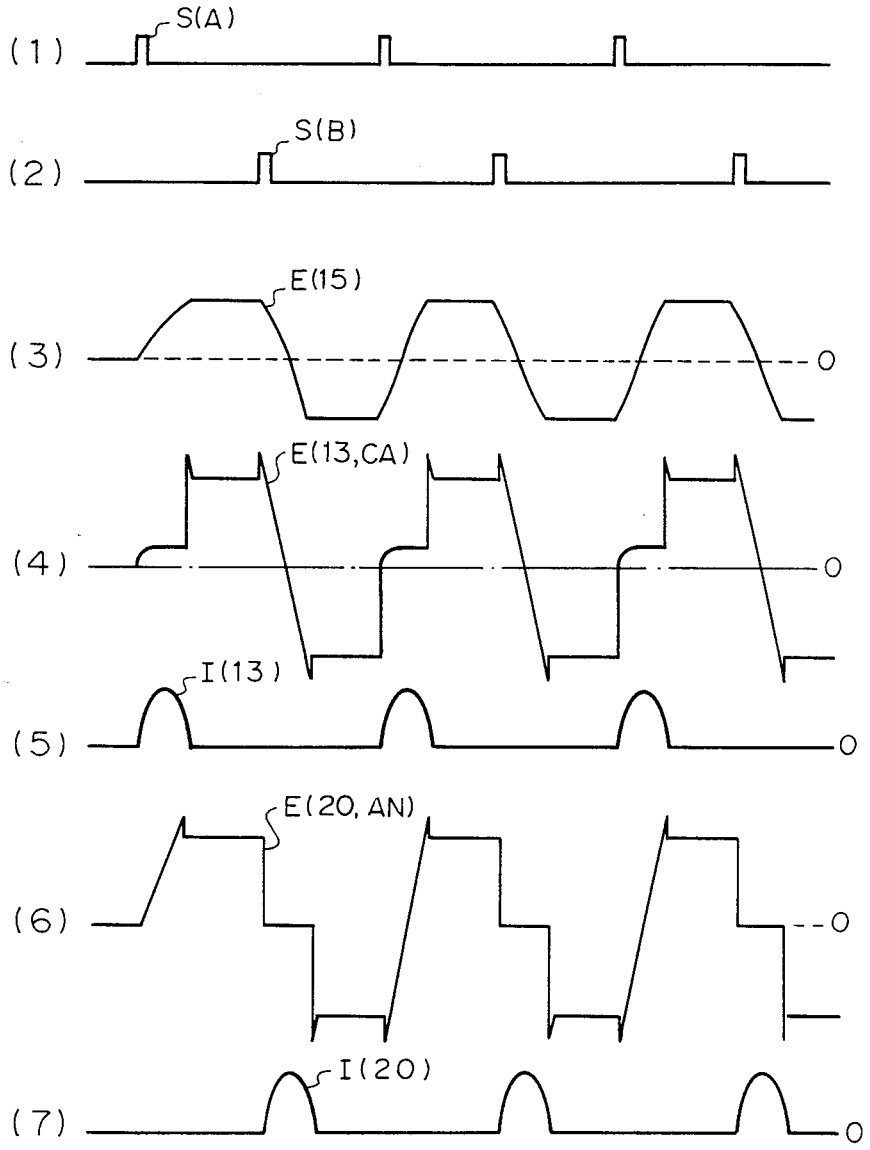
FIG. 6 is the timing chart shown in FIG. 5 enlarged with respect to time base.

The mode of operation of the high-voltage generator will now be described. FIG. 6 is an enlarged timing chart elongated over the time base of the signals at various points in the circuit of this embodiment. FIG. 6(1) shows the trigger signal S(A); FIG. 6(2) shows the trigger signal S(B); FIG. 6(3) shows a voltage E(15) across the ends of the capacitor 15; FIG. 6(4) shows a cathode voltage E (13, CA) of the thyristor 13; FIG. 6(5) shows an ON current I(13) of the thyristor 13; FIG. 6(6) shows an anode voltage E(20, AN) of the thyristor 20; and FIG. 6(7) shows an ON current I(20) of the thyristor 20.

The trigger signal S(A) shown in FIG. 6(1) triggers the thyristor 13 through the pulse transformer 14 and the corresponding noise preventing circuit. The trigger signal S(B) shown in FIG. 6(2) triggers the thyristor 20 through the pulse transformer 21 and the corresponding noise preventing circuit.

When the thyristor 13 is triggered, a current flows to a first closed circuit consisting of the capacitor 4, the thyristor 13, the primary coil 161, and the capacitor 15. Since the capacitance of the capacitor 4 is sufficiently larger than that of the capacitor 15, the capacitor 4 can be equivalently considered as a power source of a constant voltage (200 V). Furthermore, since the resistance of the circuit consisting of the resistances of the primary coil 161 and the thyristor 13 is sufficiently small, the first closed circuit described above resonates at a resonance frequency which is determined by a capacitance C (e.g., 1 μF) of the capacitor 15 and an inductance L (e.g., 100 μH) of the primary coil 161.

The resonance current flows to the positive terminal of the capacitor 4, the thyristor 13, the primary coil 161, the capacitor 15, and the ground terminal of the capacitor 4, as shown in FIG. 1. This resonance current has a sinusoidal waveform given, in accordance with the capacitance C and the inductance L, as:

$$i = V/\sqrt{L/C}\,\sin(1/\sqrt{LC})t \tag{1}$$

A voltage $E_L$ generated in the primary coil 161 is given by:

$$E_L = V\cos(1/\sqrt{LC})t \tag{2}$$

A voltage E(15) applied across the ends of the capacitor 15 is given by:

$$E(15) = V(1 - \cos(1/\sqrt{LC})t) \tag{3}$$

The thyristor 13 is kept ON only when $i>0$ but is commutated to the OFF state when $i \leqq 0$.

In this manner, in the device shown in FIG. 1, since the resonance current given by the equation (1) above flows through the circuit including the primary coil, the capacitor, the switching element, and the DC power source, the thyristor 13 is automatically commutated, and an additional commutation circuit need not be included.

A time $t_1$ at which the current i becomes zero in the equation (1) above is given by:

$$t_1 = \pi\sqrt{LC} \tag{4}$$

At this time $t_1$, the thyristor 13 is turned off, and the voltage of the capacitor 15 represented by the equation (2) above becomes twice the voltage (200 V) of the DC/DC converter 3 (i.e., 400 V) and is held as such.

A description will now be given with reference to the case wherein the thyristor 20 is turned on. When the thyristor 20 is turned on, a closed circuit is formed which consists of the capacitor 15, the primary coil 162, and the thyristor 20. The charge on the capacitor 15 is transferred toward the upper terminal of the capacitor 15, the primary coil 162, the thyristor 20, and the lower terminal of the capacitor 15. The current at this time is given by:

$$i = 2V/\sqrt{L/C}\,\sin(1/\sqrt{LC})t \tag{5}$$

As in the case of the thyristor 13, the thyristor 20 is kept ON for a time period $\pi\sqrt{LC}$ and is naturally commutated. Therefore, a special commutation circuit is not required.

When the thyristors 13 and 20 are alternately triggered thereafter, a current alternately flows to the primary coils 161 and 162. If no circuit loss is considered, the current flowing in the circuit, the voltage of the capacitor 15, and the voltage of the primary coils 161 and 162 continue to be dispersed upon each switching.

However, in practice, energy is consumed through the secondary coil and each circuit element produces some loss, so that a constant peak value is obtained after two or three switching operations.

The above description did not include any reference to the secondary coil 163 of the ignition coil 16. However, since the primary coils 161 and 162 and the secondary coil 163 are coupled together in a transformer configuration, a voltage 150 times that of the primary coils 161 and 162 is generated in the secondary coil 163 if the transformation ratio is 1:50. Thus, when the power source voltage V is 200 V and the transformation ratio is 150, a voltage E(163) generated in the secondary coil 163 is given by:

$$E(163)=200\times 150=30\ kV \quad (6)$$

Thus, a voltage sufficient for spark ignition is obtained.

The voltage generated in the secondary coil 163 is distributed to predetermined cylinders by the distributor 9 via the spark gaps 921, 922, 923, and 924 through the high-tension cords 931, 932, 933, and 934. The ignition sparks are then discharged to the ground electrodes of the spark gaps and ignition is performed.

When a discharge path is formed by a single discharge, the surrounding air is ionized to form an arc discharge and the induction discharge is sustained until the voltage becomes lower than a discharge voltage (about 500 V to 1 kV). The discharge time is shorter than that (about 2 msec) of a conventional ignition device. However, when the induction discharge is completed, the next cycle is immediately started. For this reason, discharge is easily performed again by ions remaining in the discharge gap. Therefore, discharge is continued without any noticeable interruption. Since this discharge time can be determined by the ignition time electrically set by the trigger signal generator 7, a time can be set that is long enough to allow successful ignition.

In the half period of the ON time of one thyristor, the other thyristor is reverse-blocked. Therefore, the repeating period of the trigger signals S(A) and S(B) can be shortened. In this manner, in the device shown in FIG. 1, a plurality of sparks can be continuously generated with extremely short periods for a suitable time during ignition control of an internal combustion engine for a vehicle, thus improving ignition performance of the internal combustion engine.

In the device shown in FIG. 1, the primary coils 161 and 162 are inserted between the thyristors 13 and 20. Therefore, even if the thyristors 13 and 20 are both turned on by noise or the like, and the charge on the capacitor 4 is discharged through these thyristors 13 and 20, an abrupt increase in the current or a flow of surge current is prevented due to the inductance and resistance of the primary coils 161 and 162. In this manner, damage to thyristors or other switching elements which can occur due to an abrupt increase in current, i.e., di/dt or a flow of surge current in the thyristors, can be prevented.

Since the capacitor 15 is connected to the intermediate tap between the primary coils 161 and 162, the increase rates dV/dt of the forward voltages applied to the thyristors 13 and 20 are respectively determined by the time constant of the capacitor 15 and the primary coil 162 and the time constant of the capacitor 15 and the primary coil 161. Therefore, these increase rates dV/dt can be kept lower than 100 V/μsec. As a result, erratic operation due to the high value of dV/dt of the voltage being applied to one thyristor upon operation of the other thyristor can be prevented.

Furthermore, according to the device of the present invention, the primary coils 161 and 162 are wound in the same direction so as to generate the magnetic fields in the same direction. The increase rates dV/dt of the voltage applied to the switching elements are then decreased, so that the switching elements operate reliably and safely.

Figure 7:
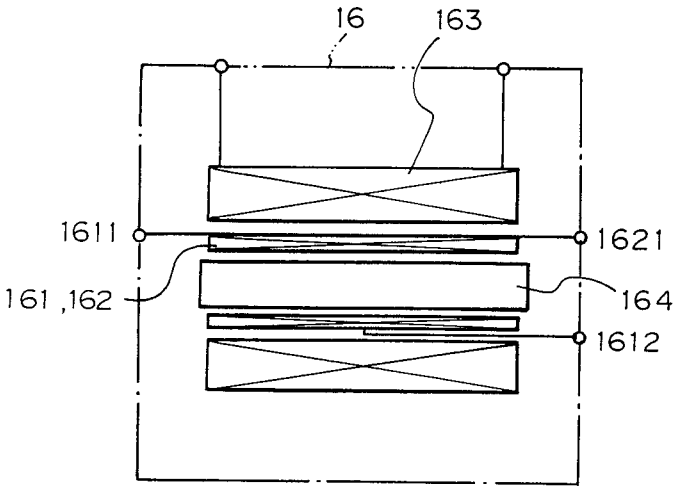
FIG. 7 is a representation showing the structure of an ignition coil in the device shown in FIG. 1.

FIG. 7 shows the construction of the ignition coil 16 in the device shown in FIG. 1. Terminals 1611 and 1621 are connected to the ends of the primary coils 161 and 162, and an intermediate terminal 1612 is connected to an intermediate point between the coils 161 and 162.

Various modifications may be made with reference to this embodiment of the present invention. For example, in the embodiment described above, the primary coils 161 and 162 are wound in the same direction. However, the coils 161 and 162 may also be wound in opposite directions to generate magnetic fields of opposite directions, and high voltages of positive and negative polarities then may be generated alternately in the secondary coil 163.

High-voltage distributing means such as the high-tension cords or distributor can be omitted with the following configuration. According to this configuration, a circuit 18 consisting of the thyristors 13 and 20, the ignition coil 16, the capacitor 15 and the like is arranged for each cylinder of a multi-cylinder internal combustion engine. The energy loss generally occurring in the high-voltage distributing means then can be decreased so as to increase the strength of the spark. Furthermore, since the high-voltage distributing means can be omitted, the overall device is rendered less expensive.

Figure 8B:
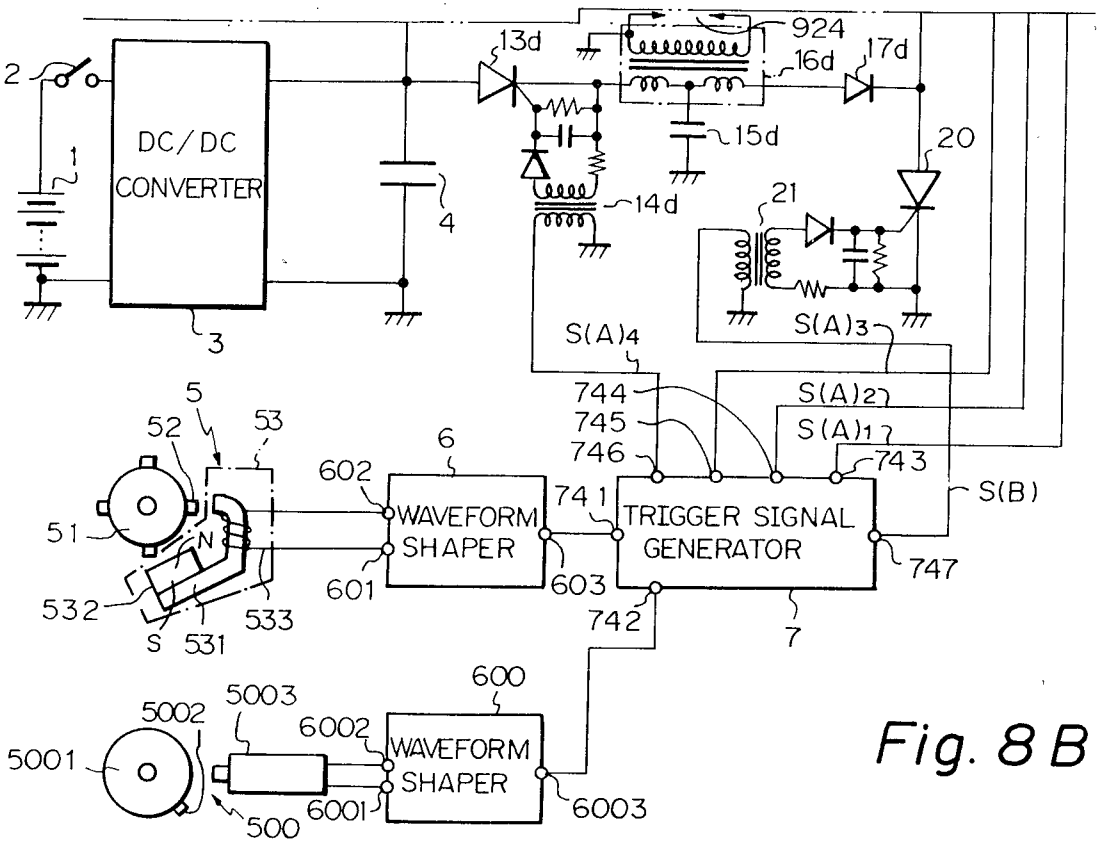

According to another embodiment of the present invention, the thyristor 20 in the device shown in FIG. 1 is commonly used for the respective cylinders of a multi-cylinder internal combustion engine, and cylinder distribution is performed with rectifying means such as diodes. Then the number of thyristors used is decreased, so that the overall device becomes less expensive. This embodiment is shown in FIGS. 8A and 8B. The same reference numerals as in FIG. 1 denote the same parts in FIGS. 8A and 8B, and a detailed description thereof will be omitted.

Referring to FIGS. 8A and 8B, a cylinder discriminator 500 has a signal rotor 5001 and a pickup 5003. The signal rotor 5001 discriminates the cylinders, and is mounted on a shaft (not shown) rotating at a frequency one half that of the engine speed. The cylinder discriminator 500 has a projection 5002. The pickup 5003 serves as a cylinder discrimination pickup and has a configuration similar to that of the pickup 53. However, the pickup 5003 is different from the pickup 53 in that the magnetic core of the pickup 53 forms a closed magnetic path with two projections while the magnetic core of the pickup 5003 has an open magnetic path.

The signal rotor 5001 and the pickup 5003 have a phase relationship different from that of the signal rotor 51 and the pickup 53 described above. The signal rotor 5001 and the pickup 5003 have a fixed phase relationship which does not change in accordance with the engine speed or load. When the signal rotor 5001 rotates once, one pulse is generated from the pickup 5003. This pulse position is set at a position 60° before the top dead center (TDC) of the piston stroke of the first cylinder. The output signal from the pickup 5003 is supplied to a waveform shaper 600. The waveform shaper 600 has the same circuit configuration as that of the waveform shaper 6.

Figures 9, 9A, 9B:
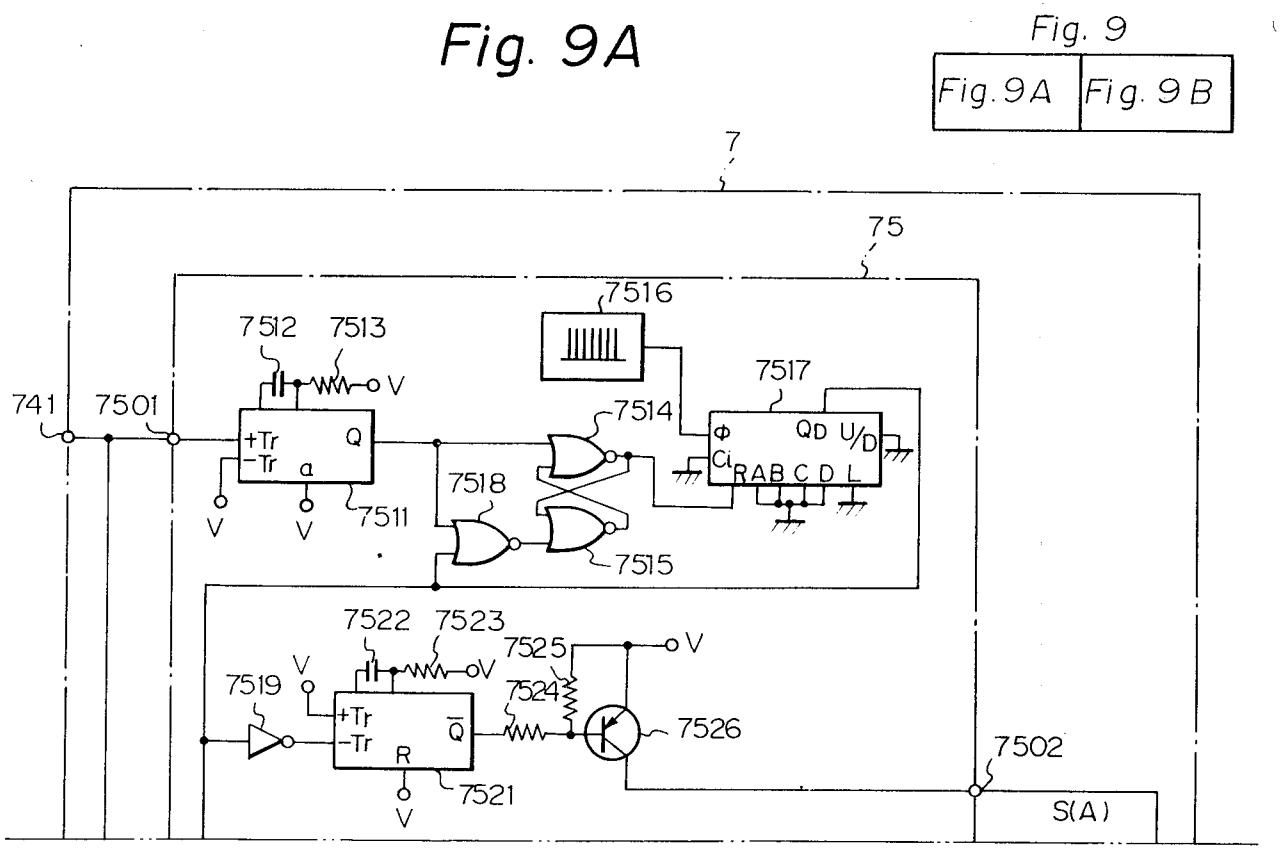
FIGS. 9, 9A and 9B are a circuit diagram of a trigger signal generator in the device shown in FIG. 8.
Figure 9B:
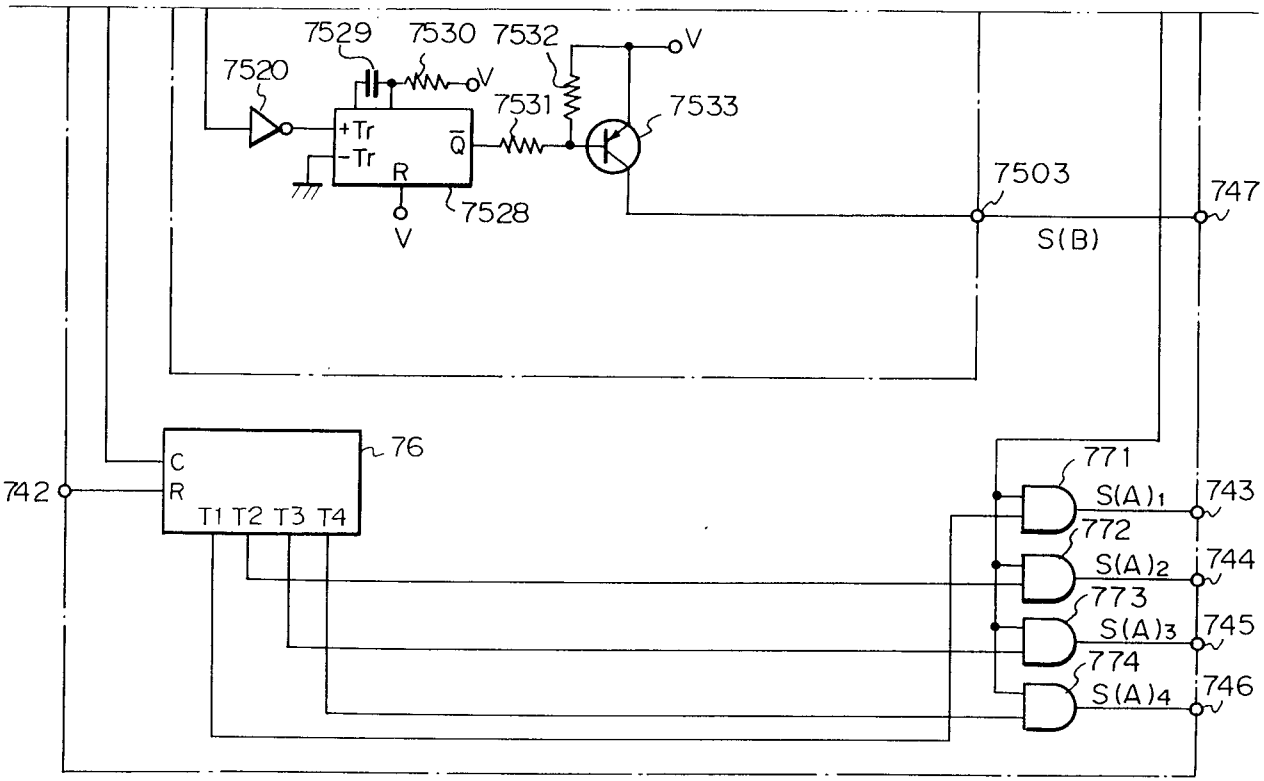
Figure 10:
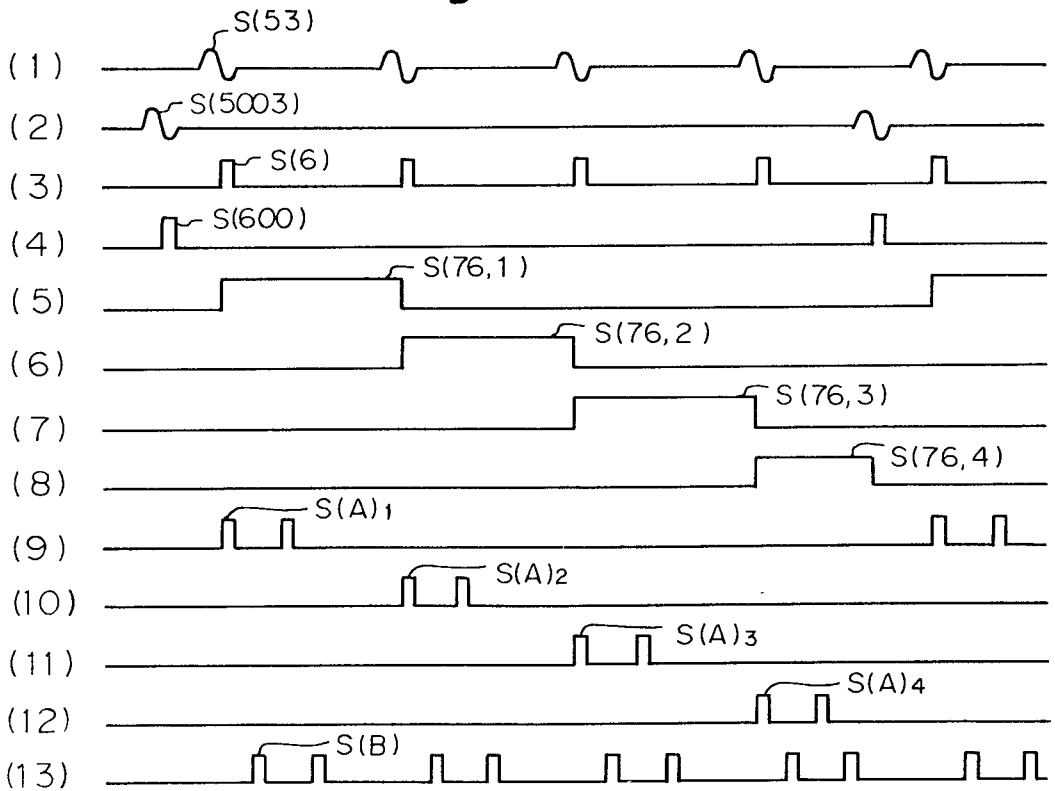
FIG. 10 is a timing chart of signals at various points of the device shown in FIG. 8.

FIGS. 9A and 9B show details of a trigger signal generator 7 in the device shown in FIGS. 8A and 8B, and FIG. 10 shows waveforms of the signals at various points in the circuit shown in FIGS. 8A, 8B, 9A, and 9B. More specifically, FIG. 10(1) shows an output S(53) from the pickup 53; FIG. 10(2) shows an output S(5003) from the pickup 5003; FIGS. 10(3) and 10(4) show outputs S(6) and S(600) from the waveform shapers 6 and 600, respectively; FIGS. 10(5), 10(6), 10(7), and 10(8), respectively, show outputs S(76, 1), S(76, 2), S(76, 3), and S(76, 4) from output terminals T1, T2, T3, and T4 of a counter 76; FIGS. 10(9), 10(10), 10(11), and 10(12), respectively, show trigger signals S(A)1, S(A)2, S(A)3, and S(A)4; and FIG. 10(13) shows the trigger signal S(B).

Referring to FIG. 9, in the trigger signal generator 7, a circuit portion indicated by reference numeral 75 is the same as the trigger signal generator in the former embodiment described above. Therefore, this circuit portion will not be described. The counter 76 is a counter with a decoder (TC4017 Toshiba) and is reset by an output signal from the waveform shaper 600, as shown in FIG. 10(4), received at its reset terminal R. A clock terminal C of the counter 76 receives an output signal (FIG. 5(3)) from the waveform shaper 6 and the counter 76 counts it.

When the counter 76 receives the first clock signal from the waveform shaper 6 after being reset by the output signal from the waveform shaper 600, the decoded signal having the waveform as shown in FIG. 10(5) is produced from the terminal T1 of the counter 76. Upon reception of the second clock signal, the signal having the waveform as shown in FIG. 10(6) appears at the output terminal T2; upon reception of the third clock signal, the signal having the waveform as shown in FIG. 10(7) appears at the output terminal T3; and upon reception of the fourth clock signal, the signal having the waveform as shown in FIG. 10(8) appears at the output terminal T4. The duration of the signal "1" at the output terminal T4 is shorter than the signals from the other terminals since the counter 76 is reset earlier.

Each of the signals appearing at the output terminals T1, T2, T3, and T4 of the counter 76 is supplied to one input terminal of each of the AND gates 771, 772, 773, and 774, the other input terminal of each of which commonly receives the trigger signal S(A) obtained from the trigger signal generator 75. The trigger signals S(A)1, S(A)2, S(A)3, and S(A)4 for the first, third, fourth, and second cylinders, respectively, appear at terminals 743, 744, 745, and 746. The trigger signal S(B) is produced from a terminal 747. FIGS. 10(9) to 10(13), respectively, show the waveforms of the trigger signals S(A)1, S(A)2, S(A)3, S(A)4, and S(B).

The mode of operation of the device shown in FIG. 8 will now be described below. The trigger signal S(A)1 is supplied to the gate terminal of a thyristor 13*a* for the first cylinder through a pulse transformer 14*a*. The thyristor 13*a* is then turned on to generate a high voltage in a secondary coil of an ignition coil 16*a* for the first cylinder, and a spark is generated in a spark gap 921 and energy is stored on a capacitor 15*a*. The energy stored on the capacitor 15*a* is not transferred to ignition coils 16*b*, 16*c*, and 16*d* of the other cylinders due to the presence of diodes 17*b*, 17*c*, and 17*d*.

When the trigger signal S(B) is applied to the gate terminal of a thyristor 20 through a pulse transformer 21, the charge on the capacitor 15*a* is discharged through a primary coil of the ignition coil 16*a*, the diode 17*a*, and the thyristor 20. Then a high voltage is generated in the secondary coil of the ignition coil 16*a*, and a spark is generated in the spark gap 921.

The above operation is repeated a predetermined number of times and ignition occurs in the other cylinders. When the voltage on the capacitor 15*a* becomes negative, the ignition at the first cylinder is terminated. Therefore, the diode 17*a* is reverse-blocked, and the ignition occurring in the other cylinders is not adversely affected.

The above operation is repeatedly performed in the order of the first, third, fourth, and second cylinders, and sparks with excellent ignition performance can be obtained near the top dead centers of the piston strokes for the respective cylinders. Since the distribution for the respective cylinders is performed by the diodes 17*a* to 17*d*, the total number of thyristors can be reduced, so that the overall device can be rendered compact in size and inexpensive. When the voltage distribution is performed by the diodes 17*a* to 17*d*, and ignition coils are arranged for the respective cylinders, a high-voltage distributing means such as the distributor or the high-tension cords can be omitted. Therefore, energy loss due to heat generation in such a high-voltage distributing means can be eliminated, the strength of the spark can be increased, and a highly efficient ignition control can be performed.

Figure 11:
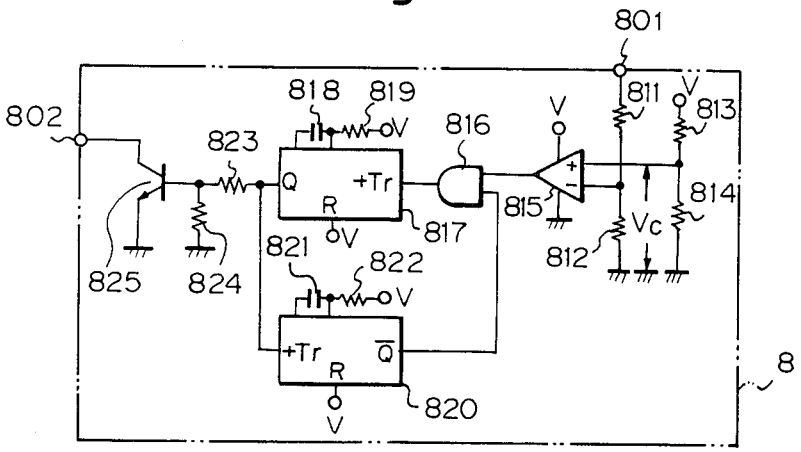
FIG. 11 is a circuit diagram showing the configuration of an abnormal voltage detector which may be used in the device shown in FIG. 1.

According to an aspect of the present invention, an abnormal voltage detector 8 is incorporated. The abnormal voltage detector 8 serves to stop the operation of the DC/DC converter 3 when the voltage on the capacitor 4 drops below a predetermined level. FIG. 11 shows details of the abnormal voltage detector 8. Referring to FIG. 11, the voltage from the capacitor 4 is supplied through a terminal 801 and is divided by resistors 811 and 812. The divided voltage is supplied to the non-inverting input terminal of a comparator 815. A voltage Vc as a reference voltage from resistors 813 and 814 is supplied to the inverting input terminal of the comparator 815. When the voltage from the capacitor 4 is less than a predetermined voltage Vd, the comparator 815 produces an output "1". However, when the voltage from the capacitor 4 is higher than Vd, the comparator 815 produces an output "0". The voltage Vd is determined by the resistors 811, 812, 813, and 814.

An output signal from the comparator 815 is supplied to a one-shot multivibrator 817 through an AND gate 816. When the output signal from the AND gate 816 goes from "0" to "1", the one-shot multivibrator 817 produces a signal "1" from an output terminal Q for a predetermined time period (e.g., 4 msec) determined by a capacitor 818 and a resistor 819. This signal is supplied to the base of a transistor 825 through resistors 823 and 824. When the Q output of the one-shot multivibrator 817 is "1", the transistor 825 is ON and its collector (terminal 802) voltage becomes zero. This zero voltage is supplied to a terminal 305 to stop the operation of the DC/DC converter 3.

The Q output from the one-shot multivibrator 817 is supplied to another one-shot multivibrator 820 which produces a signal "0" from an output terminal $\overline{Q}$ for a predetermined time period (e.g., 10 msec) determined by a capacitor 821 and a resistor 822. This signal is supplied to the AND gate 816 and the output from the AND gate 816 is kept "0" for the predetermined time period (10 msec), thereby preventing retriggering of the one-shot multivibrator 817 for this time period. The semiconductor devices below were used in this embodiment:

| | |
|---|---|
| One-shot multivibrator 817, 820 | 74LS221 (Texas Instruments) |
| AND gate 816 | TC4081BP (Toshiba) |

Figure 12:
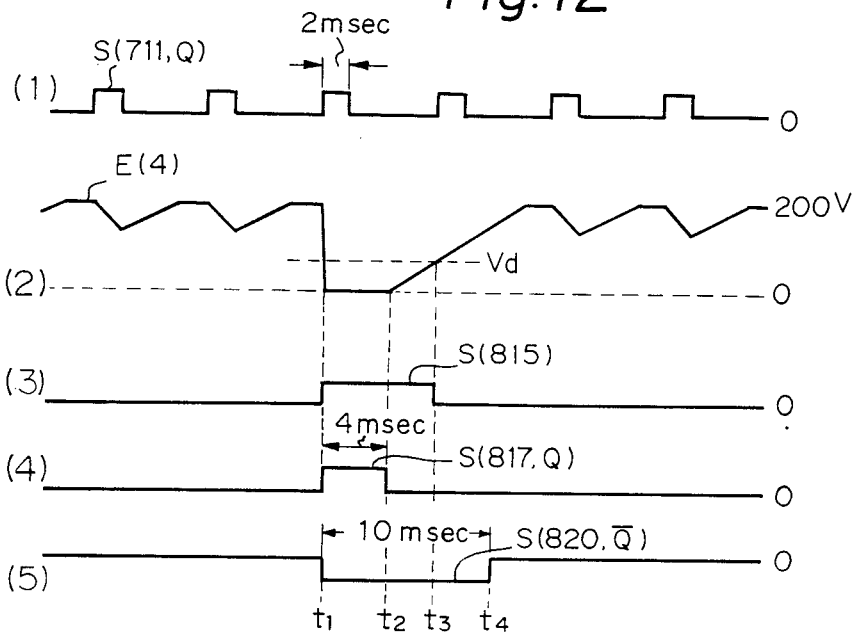
FIG. 12 is a timing chart explaining the mode of operation of the abnormal voltage detector shown in FIG. 11.

The mode of operation of the abnormal voltage detector 8 will be described below. FIG. 12 is a timing chart showing the waveforms of signals at various points of the circuit in this embodiment. FIG. 12(1) shows an ignition time signal S(711, Q) from the one-shot multivibrator 711; FIG. 12(2) shows a voltage E(4) across the ends of the capacitor 4; FIG. 12(3) shows an output signal S(815) from the comparator 815 shown in FIG. 11; FIG. 12(4) shows a Q output signal S(817, Q) from the one-shot multivibrator 817; and FIG. 12(5) shows a $\overline{Q}$ signal S(820, $\overline{Q}$) from the one-shot multivibrator 820.

Referring to FIG. 12, the device is operating normally before time $t_1$. More specifically, during the ignition period of about 2 msec shown in FIG. 12(1), the thyristor 13 and 20 of the device shown in FIG. 1 are alternately energized to cause a plurality of discharges at the spark plugs. Then the voltage on the capacitor 4 is used up and decreases from 200 V to a certain low voltage, as shown in FIG. 12(2). When the ignition time ends, a current is supplied to the DC/DC converter 3 to charge the capacitor 4 to 200 V again for the next ignition period.

When the thyristors 13 and 20 are simultaneously turned on, because of noise or the like, the charge on the capacitor 4 is transferred to the closed circuit consisting of the thyristor 13, the primary coils 161 and 162, the thyristor 20, and the capacitor 4. Thus, when the thyristors 13 and 20 are simultaneously turned on at time $t_1$ in FIG. 12, the voltage E(4) (FIG. 12(2)) across the ends of the capacitor 4 instantaneously decreases to several volts. In order to detect this abnormality, a reference voltage Vc is supplied to the non-inverting input terminal of the comparator 815, and the voltage Vd determined in accordance with the reference voltage Vc and the resistors 811 and 812 is set to be higher than the abnormal low voltage across the capacitor 4. Therefore, the output signal S(815) (FIG. 12(3)) from the comparator 815 changes from "0" to "1" at time $t_1$. The output signal "1" is supplied to the one-shot multivibrator 817 through the AND gate 816. The one-shot multivibrator 817 is triggered at the leading edge of the signal from the comparator 815 and generates the pulse signal S(817, Q) having a pulse width of about 4 msec, as shown in FIG. 12(4). This pulse signal turns on the transistor 825 to render the base voltage of the transistor 323 to zero through the terminals 802 and 305. Thus, the signal to stop the operation of the DC/DC converter 3 is supplied to the terminal 802, and the DC/DC converter 3 stops operating only for the period of about 4 msec from time $t_1$ to $t_2$ shown in FIG. 12(4). During this time period, the charge on the capacitor 4 becomes substantially zero, and the voltage across the capacitor 4 becomes zero. Then the ON currents of the thyristors 13 and 20 become zero, and the thyristors 13 and 20 are naturally commutated and reverse-blocked.

Since the output signal S(817, Q) (FIG. 12(4)) from the one-shot multivibrator 817 goes from "1" to "0" at time $t_2$, the transistor 825 is turned off. The base voltage of the transistor 323 is restored to the normal level, and the DC/DC converter 3 resumes operation.

The voltage E(4) (FIG. 12(2)) across the ends of the capacitor 4 increases upon resumption of the operation of the DC/DC converter 3 at time $t_2$, exceeds the voltage Vd at time $t_3$, and is restored to the normal level. At time $t_3$, the output signal from the comparator 815 changes from "1" to "0", and an abnormal low voltage of the capacitor 4 is no longer detected.

The $\overline{Q}$ output S(820, $\overline{Q}$) (FIG. 12(5)) from the one-shot multivibrator 820 is triggered at the leading edge of the Q output S(817, Q) (FIG. 12(4)) from the one-shot multivibrator 817 at time $t_1$. An active-low pulse signal (FIG. 12(5)) of a pulse width of about 10 msec is then supplied to one input terminal of the AND gate 816. The output from the AND gate 816 is kept at "0" during the duration of this pulse; that is, from immediately after time $t_1$ to time $t_4$. Therefore, even if the pulse of the Q output (FIG. 12(4)) of the one-shot multivibrator 817 goes to "0" at a time after time $t_2$, the one-shot multivibrator 817 will not be retriggered before time $t_4$. At time $t_4$, at which the voltage across the ends of the capacitor 4 becomes sufficiently higher than the voltage Vd, the $\overline{Q}$ output (FIG. 12(5)) from the one-shot multivibrator 820 changes from "0" to "1" and the normal state is restored. After time $t_4$, the device shown in FIG. 1 operates normally as before time $t_1$. In this manner, even if the operation is erratic and the thyristors 13 and 20 are simultaneously turned on, the abnormal voltage detector 8 serves to detect such an abnormal voltage and automatically restores the normal state within a short period of time.

In the embodiment described above, the abnormal voltage detector 8 has the comparator 815 and the resistors 811, 812, 813, and 814. However, these circuit components may be replaced with a Zener diode 830 and a photocoupler 832, as shown in FIG. 13.

Figure 13:
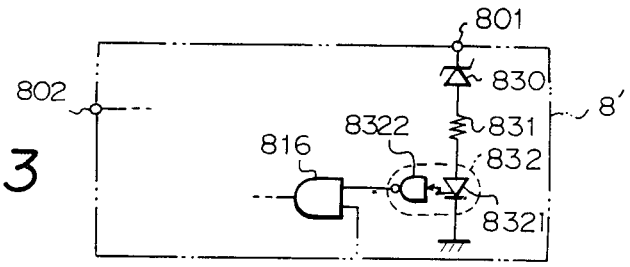
FIG. 13 is a circuit diagram of a modification of the abnormal voltage detector shown in FIG. 11.

An abnormal voltage detector 8' shown in FIG. 13 has the Zener diode 830, a resistor 831, and the photocoupler 832 (e.g., Toshiba TLP552) in place of the comparator 815 and the resistors 811, 812, 813, and 814 of the abnormal voltage detector 8 shown in FIG. 11. The remaining features of the abnormal voltage detector 8' are the same as those of the abnormal voltage detector 8 shown in FIG. 11.

The operation of the abnormal voltage detector 8' will now be described. When the voltage across the ends of the capacitor 4 becomes lower than the voltage Vd, a light-emitting element 8321 of the photocoupler 832 is turned off and the output signal from a light-receiving element 8322 goes to "1", representing an abnormal voltage. The element 8322 then supplies the signal "1" to a first input terminal of the AND gate 816. When the voltage across the ends of the capacitor 4 exceeds the voltage Vd, the light-emitting element 8321 of the photocoupler 832 is turned on and the output from the light-receiving element 8322 goes to "0", which is supplied to the first input terminal of the AND gate 816. A Zener voltage $V_2$ of the Zener diode 830 is set to be lower than the voltage Vd by several volts. Therefore, when a voltage higher than the voltage Vd is applied to the terminal 801 of the abnormal voltage detector 8', the light-emitting element 8321 of the photocoupler 832 is turned on. The resistor 831 is for current limitation purposes, to prevent damage to the light-emitting element 8321 of the photocoupler 832 and to the Zener diode 830 due to a surge current.

The abnormal voltage detector 8' shown in FIG. 13 has a simpler circuit configuration than that shown in FIG. 11. Futhermore, the output section of the DC/DC converter 3 can be electrically isolated from the logic circuit section of the abnormal voltage detector 8', so that the introduction of noise into the logic circuit section through the ground line can be prevented.

Figure 14:
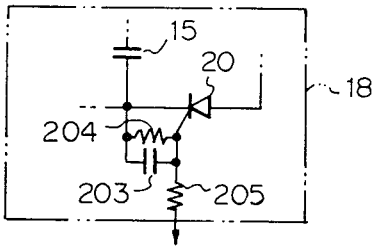
FIG. 14 is a circuit diagram of a modification of a thyristor circuit in the device shown in FIG. 1.

The pulse transformer 21, the diode 201, and the resistor 202 constituting the gate circuit of the thyristor 20 in the device shown in FIG. 1 can be replaced with a resistor 205, as shown in FIG. 14. Thus, the circuit can be simplified, and the cost of the overall device can be reduced. In the circuit shown in FIG. 14, a collector current of the transistor 733 is limited by the resistor 205 through the terminal 703 and the limited current flows to the gate of the thyristor 20.

Figures 15, 15A:
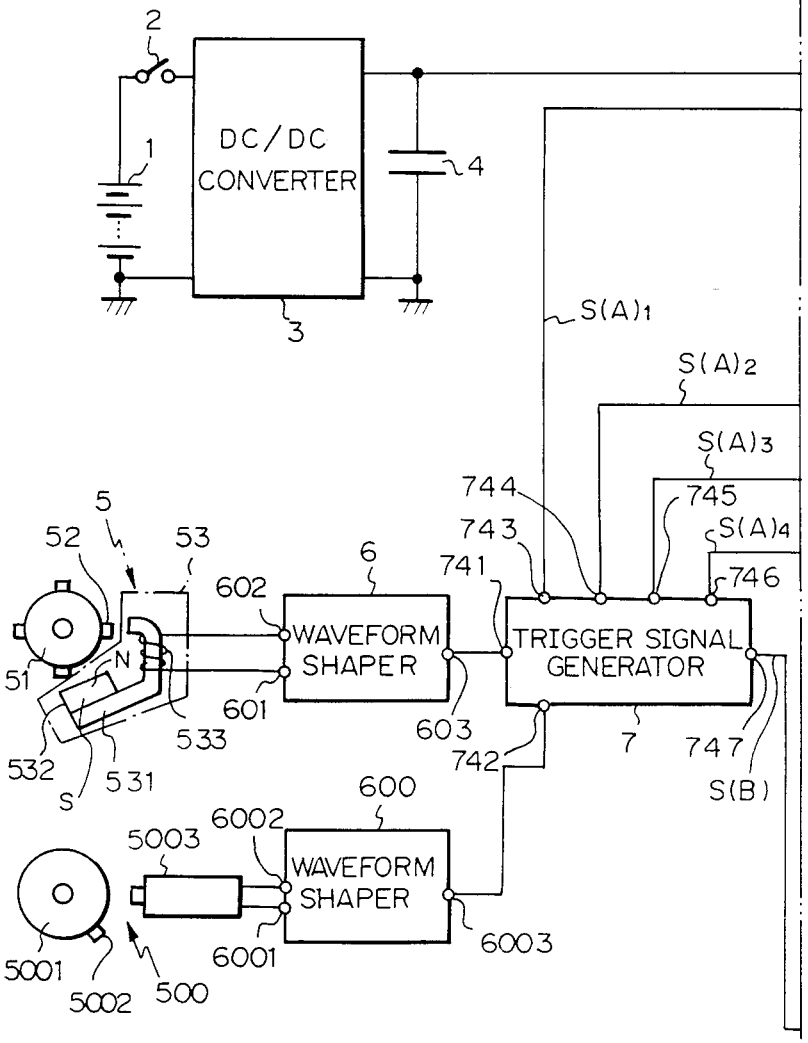
FIGS. 15, 15A and 15B are a block diagram of an ignition device according to still another embodiment of the present invention.

FIG. 15 shows an ignition device for an internal combustion engine according to still another embodiment of the present invention.

Referring to FIG. 15, a cylinder discriminator 500 has a signal rotor 5001 and a pickup 5003. The signal rotor 5001 serves to discriminate the cylinders and is mounted on a shaft rotating at a frequency half that of the engine speed. The signal rotor 5001 has a single projection 5002. The pickup 5003 also serves to discriminate the cylinders and operates in the same manner as the pickup 53. However, the magnetic core of the pickup 53 forms a closed magnetic circuit with four projections of the signal rotor 51, whereas the magnetic core of the pickup 5003 forms an open magnetic circuit.

The signal rotor 5001 and the pickup 5003 have the same phase relationship which does not change in accordance with the engine speed or load, unlike that of the signal rotor 51 and the pickup 53. When the signal rotor 51 rotates once, the pickup 5003 produces one pulse. This pulse position corresponds to a position 60° before the top dead center of the piston stroke of the first cylinder. The output from the pickup 5003 is supplied to a waveform shaper 600. The waveform shaper 600 has the same configuration as that of the waveform shaper 6.

In accordance with an ignition timing signal from the waveform shaper 6 and a cylinder discrimination signal from the waveform shaper 600, a trigger signal generator 7 generates two kinds of trigger signals, S(A)1 to S(A)4 and S(B), with a 180° phase difference between each kind, and which are repeated for a short duration within a predetermined time period. The details of the trigger signal generator 7 are the same as those shown in FIG. 9. The ignition timing signal from the waveform shaper 6 is supplied to a one-shot multivibrator 7511 through a terminal 741. The one-shot multivibrator 7511 is triggered at the leading edge of this ignition timing signal and produces a signal "1" at an output terminal Q thereof for a predetermined time period (e.g., 2 msec) determined by a capacitor 7512 and a resistor 7513.

NOR gates 7514 and 7515 are connected to constitute an R-S flip-flop. When the output signal from the one-shot multivibrator 7511 is "1", the output signal from the NOR gate 7514 is "0" while that from the NOR gate 7515 is "1". A binary presettable up/down counter 7517 is a 4-bit counter and receives at its reset terminal R the output signal from the NOR gate 7514. When the output signal from the NOR gate 7514 becomes "0", the R-S flip-flop is reset. This counter 7517 is set in the down count mode and its preset function is not used.

A clock generator 7516 continuously generates clock signals having a frequency of, for example, about 80 kHz. The clock signals are supplied to a clock input terminal Ø of the counter 7517. One input terminal of a NOR gate 7518 is connected to the output terminal of the one-shot multivibrator 7511, and the other input terminal thereof is connected to a $Q_D$ output terminal as a 1/16 frequency division output terminal of the counter 7517. When the levels of both input signals are "0", the output signal from the NOR gate 7518 becomes "1". This signal "1" is supplied to the NOR gate 7515 so as to invert the R-S flip-flop consisting of the NOR gates 7514 and 7515.

The $Q_D$ output from the counter 7515 is supplied to one-shot multivibrators 7521 and 7528 through inverter buffers 7519 and 7520, respectively. The one-shot multivibrator 7521 is triggered at the trailing edge of the output signal from the inverter buffer 7519 and generates a signal "0" from its $\overline{Q}$ terminal for a time period (e.g., 5 μsec) determined by a capacitor 7522 and a resistor 7523. The signal "0" from the $\overline{Q}$ terminal of the one-shot multivibrator 7521 is supplied to the base of a transistor 7526 through resistors 7524 and 7525. When the $\overline{Q}$ terminal of the one-shot multivibrator 7521 is "0", the transistor 7526 is turned on and generates a trigger signal S(A) "1" at its collector or terminal 7502.

The one-shot multivibrator 7528 is triggered at the leading edge of the output signal from the inverter buffer 7520 and produces a signal "0" at its output terminal $\overline{Q}$ for a time period (e.g., 5 μsec) determined by a capacitor 7529 and a resistor 7320. This signal "0" is supplied to the base of a transistor 7533 through resistors 7531 and 7532. When the $\overline{Q}$ terminal of the one-shot multivibrator 7528 is "0", the transistor 7533 is turned on and produces a trigger signal S(B) "1" to a terminal 747 through its collector or terminal 7503.

The counter 76 is a counter with a decoder. A reset terminal R of the counter 76 receives an output signal from the waveform shaper 600, by which the counter 76 is reset. A clock terminal C of the counter 76 receives an output signal from the waveform shaper 6 and counts it. The output signals from decoding output terminals T1, T2, T3, and T4 of the counter 76 are supplied to one input terminal of each of AND gates 771, 772, 773, and 774, respectively. The other input terminal of each of these AND gates commonly receives the trigger signal S(A) from terminal 7502. As the result of the AND logic function, the AND gates 771, 772, 773, and 774, respectively, produce the trigger signals S(A)1, S(A)2, S(A)3, and S(A)4 from terminals 743, 744, 745, and 746.

Four sparks plugs are provided in each of 4 cylinders so that 16 plugs are provided in all.

Figure 15B:
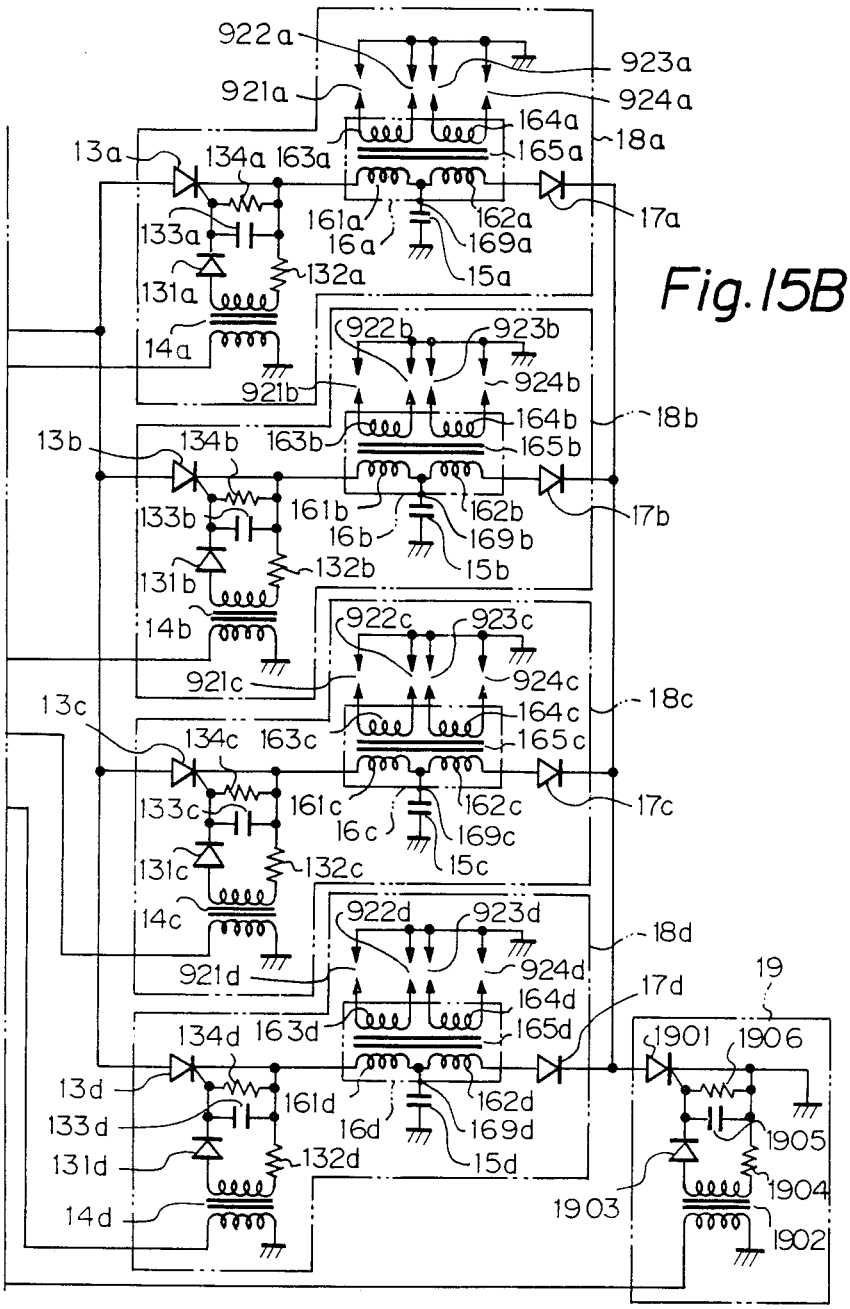

Referring to FIGS. 15A and 15B, four power circuits **18*a* to 18*d*, which are arranged for the respective cylinders and operate together in common with a power circuit 19, carry out a switching operation during a predetermined period in accordance with the power supply from the DC/DC converter 3 and trigger signals S(A)1, S(A)2, S(A)3, S(A)4, and S(B) from the trigger signal generation circuit 7, so that the 16 spark plugs 921*a* to 921*d*, 922*a* to 922*d*, 923*a* to 923*d*, and 924*a* to 924*d*** in four cylinders are caused to spark.

The power circuit **18*a* and 19** will now be described.

In the power circuit **18*a*, the anode of the thyristor 13*a* is connected to the positive terminal of the capacitor 4, and the cathode is connected to one end of a primary coil 161***a* of an ignition coil 16*a*. The gate of the thyristor 13*a* receives the trigger signal S(A)1 from the trigger signal generator 7 through an insulating pulse transformer 14*a* and a noise preventing circuit consisting of a diode 131*a*, a resistor 132*a*, a capacitor 133*a*, and a resistor 134*a*.

A resonance capacitor 15*a* is connected to a primary coil intermediate tap 169*a* of the ignition coil 16*a*. The thyristor 13*a* forms a closed circuit consisting of the capacitor 4, the thyristor 13*a*, the first primary coil 161*a*, and the resonance capacitor 15*a*.

In the power circuit 19, the anode of a thyristor 1901 is connected to one end of a second primary coil 162*a* of the ignition coil 16*d* through a diode 17*a*, and the cathode of the thyristor 1901 is connected to one end (GND) of the resonance capacitor 15*a*. The gate of the thyristor 1901 receives the trigger signal S(B) from the trigger signal generator 7 through a pulse transformer 1902 and a noise preventing circuit consisting of a diode 1903, resistors 1904 and 1906, and a capacitor 1905. Another closed circuit is formed by the thyristor 1901 and the resonance capacitor 15*a*.

Figure 16:
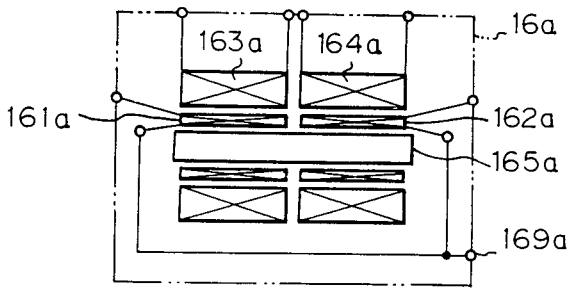
FIG. 16 is a representation showing the structure of an ignition coil in the device shown in FIG. 15.

The ignition coil 16*a* consists of the first primary coil 161*a*, the second primary coil 162*a*, a first secondary coil 163*a*, a second secondary coil 164*a*, and an iron core 165*a*. FIG. 16 shows the structure of this ignition coil 16*a*.

The first and second primary coils 161*a* and 162*a* have about 40 turns, and the first and second secondary coils 163*a* and 164*a* have about 6,000 turns. These coils are wound around the iron core 165*a*. The turn ratio of the primary coils to the secondary coils is set to be about 150.

The first and second primary coils 161*a* and 162*a* have a common node (primary coil intermediate point) 169*a* connecting one end of each of the first and second primary coils 161*a* and 162*a*.

The first and second secondary coils 163*a* and 164*a* are magnetically coupled to the first and second primary coils 161*a* and 162*a* through the iron core 165*a*. Voltages generated in the primary coils 161*a* and 162*a* are boosted and the boosted high voltages are produced from the first and second secondary coils 163*a* and 164*a*.

As shown in FIG. 16, the first primary coil 161*a* and the first secondary coil 163*a* are wound concentrically at the same position along the axial direction of the iron core 165*a*, in such a manner that there is a strong magnetic coupling between the first primary coil 161*a* and the first secondary coil 163*a* and between the second primary coil 162*a* and the second secondary coil 164*a* of the ignition coil 16*a*. In contrast to this, the magnetic coupling between the first primary coil 161*a* and the second secondary coil 164*a* and between the second primary coil 162*a* and the first secondary coil 163*a* is weak.

The output terminals of the first and second secondary coils 163*a* and 164*a* are connected to a total of four spark plugs 921*a*, 922*a*, 923*a*, and 924*a*.

Although the construction of only the power source 18*a* is described in detail above, the remaining power circuits 18*b*, 18*c*, and 18*d* have the same construction and a description thereof will be omitted. However, note that the power circuits 18*b*, 18*c*, and 18*d* are different from the power circuit 18*a* in that they receive the trigger signals S(A)2, S(A)3, and S(A)4, respectively.

The respective semiconductor devices used in the device shown in FIGS. 15A and 15B are as follows:

| | |
|---|---|
| One-shot multivibrator 7511 | TC4528BP (Toshiba) |
| NOR gates 7514, 7515, 7518 | TC4001BP (Toshiba) |
| Up/down counter 7517 | TC4516BP (Toshiba) |
| Inverters 7519, 7520 | TC4049BP (Toshiba) |
| One-shot multivibrators 7521, 7528 | 74LS221 (Texas Instruments) |
| Decoder type counter 76 | TC4017BP (Toshiba) |
| AND gates 771, 772, 773, 774 | TC4018BP (Toshiba) |

The mode of operation of the device shown in FIG. 15 will now be described.

Figure 17:
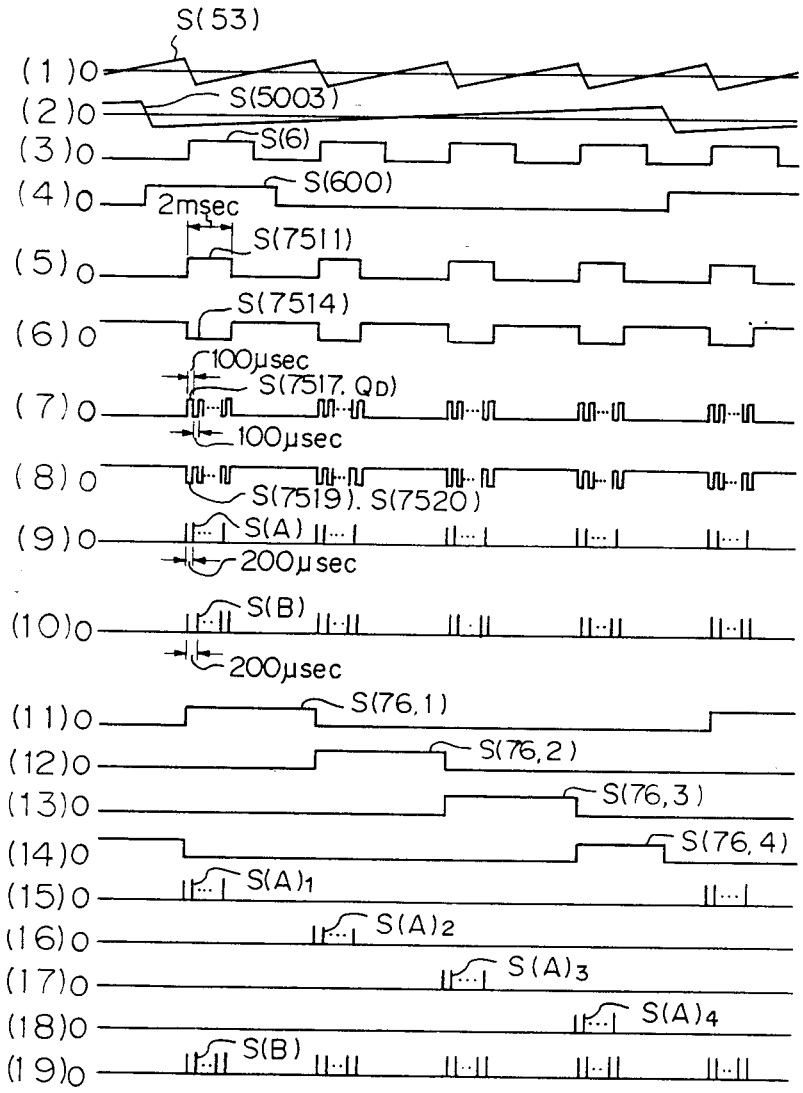
FIG. 17 is a timing chart of signals at various points in the device shown in FIG. 15.

FIG. 17 is a timing chart showing the signal waveforms at various points in the device shown in FIGS. 15A and 15B. FIG. 17(1) shows an output voltage S(53) from the pickup 53; FIG. 17(2) shows an output voltage S(5003) from the pickup 5003; FIG. 17(3) shows an ignition timing signal S(6) from the waveform shaper 6; FIG. 17(4) shows a cylinder discrimination signal S(600) from the waveform shaper 600; FIG. 17(5) shows an ignition time signal S(7511) from the one-shot multivibrator 7511; FIG. 17(6) shows an output signal S(7514) from the NOR gate 7514; FIG. 17(7) shows an output signal S(7517, $Q_D$) from the counter 7517; FIG. 17(8) shows output signals S(7519) and S(7520) from the inverter buffers 7519 and 7520; FIG. 17(9) shows the trigger signal S(A); FIG. 17(10) shows the trigger signal S(B); FIGS. 17(11) to FIG. 17(14) respectively show cylinder selection signals S(76, 1), S(76, 2), S(76, 3), and S(76, 4) from the output terminals T1, T2, T3, and T4 of the counter 76; FIG. 17(15) to 17(18) respectively show the trigger signals S(A)1, S(A)2, S(A)3, and S(A)4 from the AND gates 771, 772, 773, and 774; and FIG. 17(19) shows the trigger signal S(B) from the transistor 7533.

When the engine key switch 2 is turned on, a DC voltage of +12 V is applied from the DC power source 1 to the DC/DC converter 3 which generates a voltage of +200 V. This voltage of +200 V is constantly stored on the capacitor 4.

As the engine rotates, the signal rotor 51 rotates, and a voltage having the waveform shown in FIG. 17(1) is generated in the coil 533 of the pickup 53. The time point at which this voltage changes from positive to negative is an ignition timing. The coil 533 is biased by the bias voltage Vb from the waveform shaper 6, so that the comparator 614 can operate normally. The boosted voltage is shaped by the waveform shaper 6 in accordance with the comparison result obtained from the comparator 614, and the signal rises at the ignition timing as shown in FIG. 17(3).

As the engine rotates further, the signal rotor 5001 rotates. In the same manner as that of the pickup 53, the voltage having the waveform shown in FIG. 17(2) is produced in the pickup 5003. The time point at which this voltage changes from positive to negative is a cylinder discrimination timing. This voltage is shaped by the waveform shaper 600 having the same configuration as that of the waveform shaper 6 and rises at the cylinder discrimination timing shown in FIG. 17(4).

The output signal from the waveform shaper 6 is supplied to the trigger signal generator 7. The one-shot multivibrator 7511 is triggered at the leading edge of the output signal from the waveform shaper 6 and produces a pulse-like ignition timing signal having a pulse width of about 2 msec, as shown in FIG. 17(5). This pulse width is given as the ignition timing. The ignition timing signal is supplied to the NOR gate 7514 to invert the flip-flop consisting of the NOR gates 7514 and 7515, and the output signal from the NOR gate 7514 then becomes "0" as shown in FIG. 17(6).

The output signal from the NOR gate 7514 is supplied to the reset terminal of the counter 7517. When the output signal from the NOR gate 7514 is "0", the counter 7517 is released from the reset state. When the counter 7517 is released from the reset state, it starts counting clocks generated by the clock generator 7516 at a frequency of about 80 kHz. The counter 7517 is a 4-bit binary counter and is set in the down count mode. Therefore, at the leading edge of the initial clock signal, the count of the counter 7517 changes from 0 to 15. Thus, the $Q_D$ output from the counter 7517 changes from "0" to "1". Thereafter, the counter 7517 repeatedly counts down and the count changes periodically in the order of 0, 15, 14, . . . , 2, 1, 0, 15 and so on. At this time, the $Q_D$ output as the 1/16 frequency division output is "1" when the count of the counter 7517 falls within the range of 8 to 15. Therefore, the counter 7517 generates a square wave having a duty ratio of about 50% as shown in FIG. 17(7) and having the frequency 1/16 that of the clock frequency. The output shown in FIG. 17(7) has a pulse width of 100 μsec and a pulse separation of 100 μsec.

At about 2 msec from the leading edge of the ignition timing signal, the input to the NOR gate 7514 becomes "0". If the counter 7517 is reset immediately, the immediately preceding $Q_D$ output has a "1" period shorter than the normal "1" period. Therefore, the natural commutation of the thyristor to be described later cannot be performed. To prevent this, the outputs from the one-shot multivibrator 7511 and the counter 7517 are supplied to the input terminals of the NOR gate 7518. Thus, the output signal from the NOR gate 7518 becomes "1" only when the $Q_D$ output is "0", to invert the flip-flop consisting of the NOR gate 7514 and 7515. The output signal from the NOR gate 7514 then becomes "1", and the counter 7517 is reset.

In this manner, at least an integer number of square waveform pulses having a frequency (5 kHz) 1/16 of the clock frequency appear in the $Q_D$ output within a delay time falling within one period (12.5 μsec) of the clock signal from the ignition timing signal. This signal is inverted by the inverter buffers 7519 and 7520 to become a signal as shown in FIG. 17(8).

The one-shot multivibrator 7521 is triggered at the trailing edge of the inverter buffer 7519 to generate a pulse having a pulse width of about 5 μsec which turns on the transistor 7526. The transistor 7526 generates the trigger signal S(A) shown in FIG. 17(9) to the terminal 7502. The one-shot multivibrator 7528 is triggered at the leading edge of the output signal from the inverter buffer 7520, generating a pulse having a pulse width of about 5 μsec to turn on the transistor 7533. The transistor 7533 generates the trigger signal S(B) having the waveform shown in FIG. 17(10) from the terminal 7503. The trigger signals S(A) and S(B) are signals which have phases shifted from each other by 180°, a period of 200 μsec, and a pulse width of 5 μsec.

The output signal from the waveform shaper 600 is supplied to the trigger signal generator 7. When the counter 76 receives the first signal from the waveform shaper 6 after being reset by the leading edge of the output signal from the waveform shaper 600, the output terminal T1 of the counter 76 generates a first cylinder selection signal having the decoded waveform as shown in FIG. 17(11). Similarly, upon reception of the second signal, the output terminal T2 of the counter 76 generates a third cylinder section signal shown in FIG. 17(12), upon reception of the third signal, the output terminal T3 generates a fourth cylinder selection signal as shown in FIG. 17(13), and upon reception of the fourth signal, the output terminal T4 of the counter generates a second cylinder selection signal as shown in FIG. 17(13). The "1" period of the signal appearing at the output terminal T4 is shorter than that of the other signals as the counter 76 is reset earlier in this case.

The output signals from the output terminals T1, T2, T3, and T4 of the counter 76 are respectively supplied to one input terminal of each of the AND gates 771, 772, 773, and 774, the other input terminals of which receive in common the trigger signal S(A) shown in FIG. 17(9) supplied from the transistor 7526. Therefore, the first cylinder trigger signal S(A)1 is produced from the terminal 743, the third cylinder trigger signal S(A)2 is produced from the terminal 744, the fourth cylinder trigger signal S(A)3 is produced from the terminal 745, and the second cylinder trigger signal S(A)4 is produced from the terminal 746. The signals S(A)1, S(A)2, S(A)3, S(A)4, and S(B) have the waveforms shown in FIGS. 17(15), 17(16), 17(17), 17(18), and 17(19), respectively.

Figure 18:
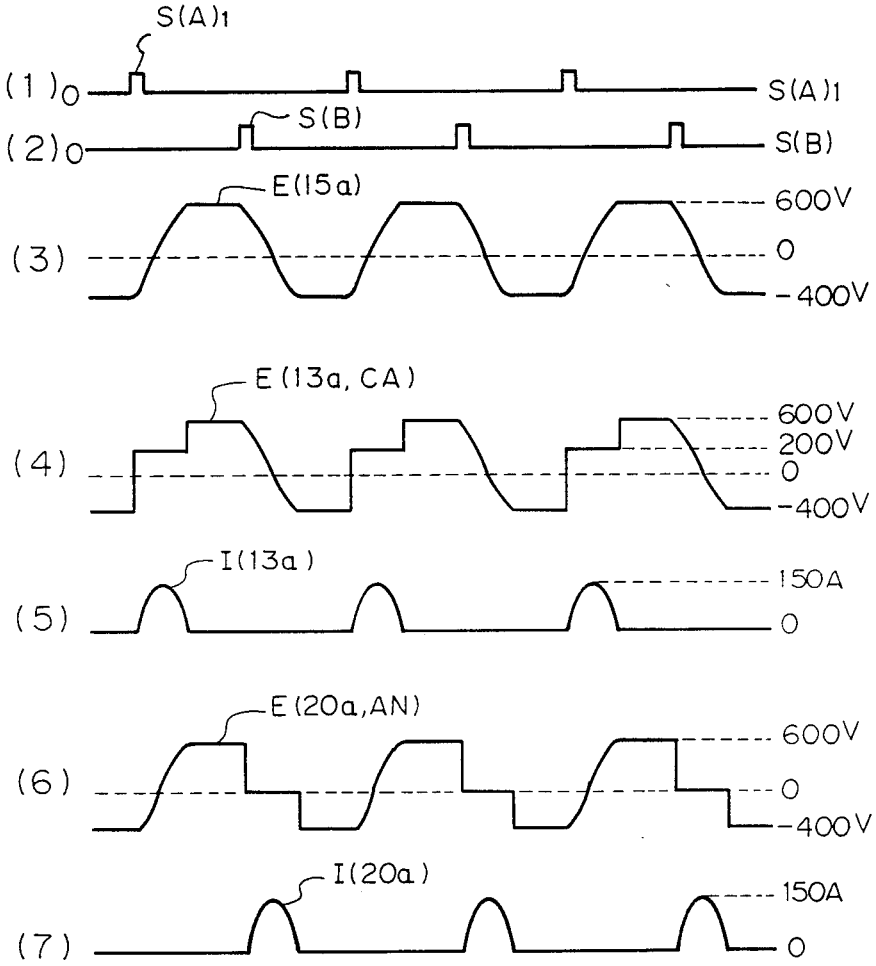
FIG. 18 is a timing chart explaining the mode of operation of a high-voltage generator in the device shown in FIG. 15.

The mode of operation of the high-voltage generating section will be described below. FIG. 18 is a timing chart of the signals in this embodiment with the time base shown in FIG. 17 being extended. FIG. 18(1) shows the trigger signal S(A)1; FIG. 18(2) shows the trigger signal S(B); FIG. 18(3) shows a voltage E(15*a*) from the resonance capacitor 15*a*; FIG. 18(4) shows a cathode voltage E(13*a*, CA) from the thyristor 13*a*; FIG. 18(5) shows an ON current I(13*a*) of the thyristor 13*a*; FIG. 18(6) shows an anode voltage E(20*a*, AN) of the thyristor 20*a*; and FIG. 18(7) shows an ON current I(20*a*) of the thyristor 20*a*.

The trigger signal S(A)1 shown in FIG. 18(1) triggers the thyristor 13*a* through the insulating pulse transformer 14*a* and the noise preventing circuit. Similarly, the trigger signal S(B) shown in FIG. 18(2) triggers the thyristor 20 through the pulse transformer 21 and the corresponding noise preventing circuit.

When the thyristor 13*a* is triggered, a current flows to the closed circuit consisting of the capacitor 4, the thyristor 13*a*, the primary coil 161*a*, and the capacitor 15*a*. Since the capacitance of the capacitor 4 is sufficiently larger than that of the capacitor 15*a*, the capacitor 4 can be equivalently considered as a power source having a predetermined voltage (200 V). Furthermore, as the resistance of the circuit consisting of the first primary coil 161*a* and the thyristor 13*a* is sufficiently small, the first closed circuit resonates at a frequency which is determined by a capacitance C (e.g., 2 μF) of the capacitor 15*a* and an inductance L (e.g., 50 μH) of the first primary coil 161*a*.

The resonance current flows toward the positive terminal of the capacitor 4, the thyristor 13*a*, the first primary coil 161*a*, the capacitor 15*a*, and the GND terminal of the capacitor 4, and has a sinusoidal (positive half cycle) waveform as shown in FIG. 18(5). The resonance current has a peak current of about 150 A and an ON time of about 20 μsec. When the resonance current is enabled, the voltage applied to the capacitor 15*a* increases to about 600 V, as shown in FIG. 18(3).

The thyristor 13*a* is kept ON only if $i > 0$ and is commutated if $i \leqq 0$, as shown in FIG. 18(5).

Therefore, in the device shown in FIGS. 15A and 15B, since the resonance current flows in the circuit including the primary coil 161*a*, the capacitor 15*a*, the thyristor 13*a*, and the DC power source, the thyristor 13*a* is automatically commutated. Thus, a special commutation circuit need not be incorporated.

When the thyristor 13*a* is turned off, the voltage on the capacitor 15*a* is about 600 V, which is about three times the DC power source voltage 200 V. This is due to the amplification function as a result of the resonance described above.

A case will now be considered wherein the thyristor 1901 is triggered. When the thyristor 1901 is turned on, a closed circuit is formed which consists of the capacitor 15*a*, the second primary coil 162*a*, the diode 17*a*, and the thyristor 1901. The charge stored on the capacitor 15*a* then flows toward the upper terminal of the capacitor 15*a*, the second primary coil 162*a*, the diode 17*a*, the thyristor 1901, and the lower terminal of the capacitor 15*a*, and has a sinusoidal waveform (positive half cycle) as shown in FIG. 18(7). As in the case of the thyristor 13*a*, the current of the thyristor 1901 has a peak current of about 150 A and an ON time of about 20 μsec. The voltage applied to the capacitor 15*a*, then decreases from about 600 A to about −400 V, as shown in FIG. 18(3). When the current of the thyristor 1901 becomes zero, as shown in FIG. 18(7), the thyristor 1901 naturally commutates, and thus a special commutation circuit need not be used.

If the thyristors 13*a* and 1901 are alternately triggered, the current alternately flows to the first and second primary coils 161*a* and 162*a*.

In the above description, the first and second secondary coils 163*a* and 164*a* of the ignition coil 16*a* were not included therein and will therefore be described below.

The first and second primary coils 161*a* and 162*a* and the first and second secondary coils 163*a* and 164*a* have a turn ratio of about 150. Therefore, a voltage about 150 times that of the primary coils is generated in the secondary coils.

Theoretically, since the voltage applied to the first and second primary coils 161*a* and 162*a* is about 600 V, a high voltage of 90 (kV) (=600 (V)×150) flows through the first and second secondary coils, as the turn ratio is about 150. However, in practice, a voltage of about 60 kV is generated due to loss through the ignition coil 16*a* and the like. However, this voltage is sufficiently high for spark ignition. Nevertheless, as described above, the magnetic coupling between the first primary coil 161*a* and the first secondary coil 163*a*, and between the second primary coil 162*a* and the second secondary coil 164*a* is strong. Therefore, when the current is supplied to the first primary coil 161*a*, a high voltage is generated only in the first secondary coil 163*a*. However, when the current is supplied to the second primary coil 162*a*, a high voltage is generated only in the second secondary coil 164*a*.

The voltages generated in the first and second secondary coils 163*a* and 164*a* are supplied to the spark plugs 921*a*, 922*a*, 923*a*, and 924*a*, and sparks are produced in the spark gaps.

When the discharge paths are formed by the discharge, the surrounding air is ionized to form an arc discharge and the induction discharge is sustained until the voltage becomes lower than the discharge voltage (about 500 V to 1 kV). The discharge time is relatively short (about 2 msec) compared with that of a conventional ignition device. However, when this induction discharge ends, the next cycle is started, so that charging can be resumed immediately. Thus, discharge can be performed without substantial interruption. The discharge time can be determined by the ignition time electrically set by the trigger signal generator 7, and therefore, the discharge time can be preset for a period long enough to assure safe ignition.

While one thyristor is turned on, the remaining thyristors are reverse-blocked. Therefore, the repetition period of the trigger signals S(A) and S(B) can be shortened. In this manner, the device shown in FIGS. 15A and 15B can continuously produce a plurality of sparks of an extremely short duration for a suitable period of time in the ignition control of an internal combustion engine for a vehicle, so that the ignition performance of the internal combustion engine can be improved.

The above description has been made with reference to the portion of the circuit shown in FIGS. 15A and 15B which is associated with ignition of the first cylinder. That is, only the power circuits 18*a* and 19 were described for the high-voltage generating section.

However, ignition for the third, fourth, and second cylinders is performed in a similar manner, and a detailed description thereof will be omitted. However, the paired power circuits 18*b* and 19, the paired power circuits 18*c* and 19, and the paired power circuits 18*d* and 19 are sequentially energized for the third, fourth, and second cylinders, so that the ignition coils 16*c*, 16*d*, and 16*b* are repeatedly turned on.

Diodes 17*a*, 17*b*, 17*c*, and 17*d* are incorporated to prevent mutual interference between the power circuits 18*a*, 18*b*, 18*c*, and 18*d*. The function of these diodes will be described below.

The power circuits 18*a*, 18*b*, 18*c*, 18*d*, and 19 are operated in such a manner that the power circuits 18*a*, 18*b*, 18*c*, and 18*d* end ignition when the power circuit 19 is turned on; that is, the thyristor 1901 is turned on. Therefore, after the thyristor 1901 is turned on, the voltages on the capacitors 15*a*, 15*b*, 15*c*, and 15*d* are about −500 V, as can be seen from FIGS. 18(3) to 18(7), and thus the diodes of the cylinders among those 17*a* through 17*d* of the cylinders 15*a* through 15*d* which are not in the ignition timing period are reverse-blocked.

The power circuits which are not in the ignition timing period are separated through the corresponding diodes 17*a* through 17*d*, so that the power circuit in the ignition timing period is not adversely affected.

The above operation is repeated for the cylinders in the order of the first, third, fourth, and second cylinders. Then discharge is repeatedly performed in the four spark plugs near the top dead centers of the piston strokes in the respective cylinders, thereby achieving reliable ignition.

Figure 19:
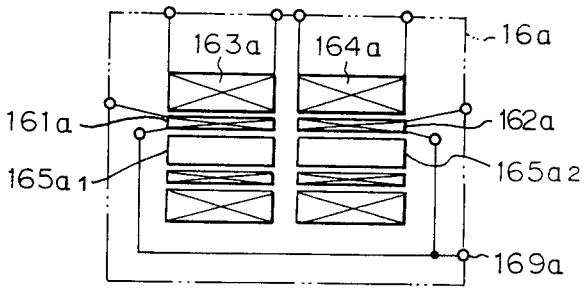
FIG. 19 is a representation showing another example of an ignition coil in the device shown in FIG. 15.

In the embodiment described above, only one iron core 165*a* is used for the ignition coil 16*a* shown in FIG. 16. However, as shown in FIG. 19, the iron core 165*a* can be divided into core sections to attenuate the magnetic coupling between the first primary coil 161*a* and the second secondary coil 164*a* and between the second primary coil 162*a* and the first secondary coil 163*a*. As a result, when the current is supplied to the first primary coil 161*a*, a high voltage is generated only in the first secondary coil 163*a* and substantially no voltage is generated in the second secondary coil 164*a*. Therefore, among the spark plugs connected to the ignition coil 16*a*, only the spark plugs 921*a* and 922*a* can reliably discharge. Conversely, when the current is supplied to the second primary coil 162*a*, a high voltage is generated only in the second secondary coil 164*a*, and substantially no voltage is generated in the first secondary coil 163*a*. Therefore, only the spark plugs 923*a* and 924*a* can reliably discharge. Although the above description has been made with reference to the ignition coil 16*a* alone, the remaining ignition coils 16*b*, 16*c*, and 16*d* operate in a similar manner.

Figure 20:
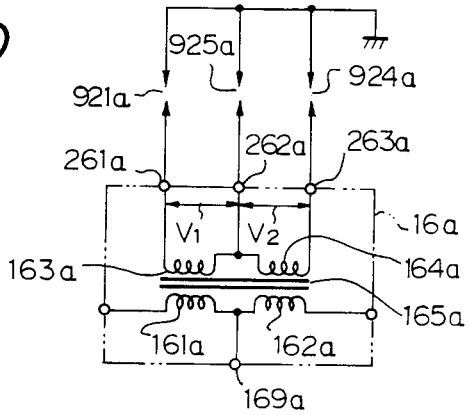
FIG. 20 is a circuit diagram of the connection between the ignition coil and a spark plug in the device shown in FIG. 15.

In the embodiment described above, four spark plugs are connected to each ignition coil. However, the embodiment can be modified so that only three spark plugs are connected to each ignition coil. In the construction shown in FIG. 20, a secondary coil intermediate terminal 262*a* commonly connects one terminal of the first primary coil 163*a* and one terminal of the second secondary coil 164*a*. Three spark plugs 921*a*, 925*a*, and 924*a* are connected to terminals 261*a*, 262*a*, and 263*a*. However, care must be taken with the connection of the secondary coil intermediate terminal 262*a*. As described with reference to the above embodiment, the first and second primary coils 161*a* and 162*a* are wound around the iron core 165*a* in such a manner that they generate magnetic fields in the same direction upon being energized. Therefore, irrespective of which of the primary coils 161*a* and 162 is energized, power of the same direction is generated in the first and second secondary coils 163*a* and 164*a*. That is, the polarity of a voltage V1 generated between the terminals 261*a* and 262*a* connected to the ends of the first secondary coil 163*a* remains the same irrespective of which of the first and second primary coils 161*a* and 162*a* is energized. This also applies to the case of the second secondary coil. Utilizing this fact, the secondary coil intermediate terminal 262*a* is provided to commonly connect one terminal of each of the first and second secondary coils 163*a* and 164*a* in such a manner that the voltage V1 generated between the terminals 261*a* and 262*a* at the ends of the first secondary coil 163*a* and a voltage V2 generated between the terminals 262*a* and 263*a* at the ends of the second secondary coil 164*a* are subjected to a subtraction.

When a current is supplied to the first primary coil 161*a*, the voltage V1, which is sufficiently high to discharge the spark plugs 921*a* and 925*a*, is applied thereto to cause discharge. Then a voltage lower than the voltage applied to the spark plug 925*a* by the voltage V2 is applied to the spark plug 924*a*, which therefore does not discharge.

When a current is supplied to the second primary coil 162*a*, the voltage V2, which is sufficiently high to cause the spark plugs 925*a* and 924*a* to discharge, is applied thereto. However, a voltage lower than that applied to the spark plug 925*a* by the voltage V1 is applied to the spark plug 921*a* so that spark plug 921*a* does not discharge.

In this manner, the spark plugs 921*a* and 925*a* are paired to discharge, while the spark plugs 924*a* and 925*a* are paired to discharge. If these discharge operations are alternately repeated, the three spark plugs 921*a*, 924*a*, and 925*a* can be discharged a plurality of times at substantially the same time.

Although the above description has been made with reference to the case of the ignition coil 16*a*, the remaining ignition coils 16*b*, 16*c*, and 16*d* are of the same configuration. With this construction, one ignition coil per cylinder can ignite three spark plugs. Thus, in accordance with actual specifications of the internal combustion engine, the number of plugs per cylinder can be three or four, so that the spark plugs can be freely mounted on the cylinder head.

Figure 21:
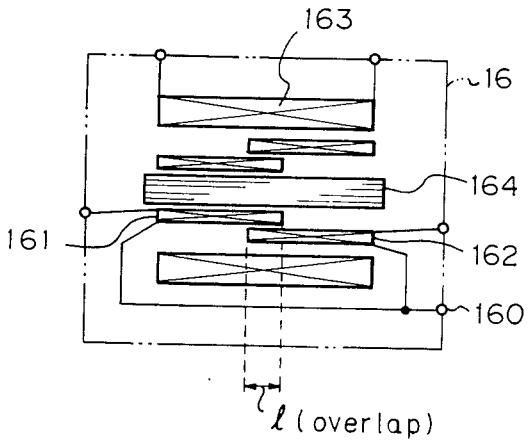
FIG. 21 is a representation showing another example of an ignition coil in the device shown in FIG. 15.

FIG. 21 shows another example of the ignition coil.

Referring to FIG. 21, an ignition coil 16 consists of a first primary coil 161, a second primary coil 162, a secondary coil 163, and an iron core 164. The first and second primary coils 161 and 162 have about 40 turns, and the secondary coil 163 has about 6,000 turns, and are respectively wound around the iron core 164. The turn ratio of the first and second primary coils 161 and 162 to the secondary coil 163 is about 150. The first and second primary coils 161 and 162 are wound around the iron core 164 in such a manner that they partially overlap, to achieve magnetic coupling at such an overlapping part. The two primary coils 161 and 162 have a node (primary coil intermediate point) 160 commonly connecting ends of the primary coils 161 and 162, so that magnetic fields of the same directions are generated in the iron core 164 when a current is supplied to the coils 161 and 162.

Thus, the first and second primary coils 161 and 162 are magnetically coupled to the secondary coil 163 through the iron core 164, and the voltage generated in the two primary coils 161 and 162 is boosted and is produced from the secondary coil 163.

One end of the secondary coil 163 is grounded (GND), and the other end is connected to the center electrode of a distributor 9 for distributing the high voltage to the respective cylinders.

The distributor 9 has a known configuration. A distributing rotor 91 of the distributor 9 is rotated by a shaft rotating at a frequency one half that of the engine speed. The distributor 9 distributes the high voltage through this rotor 91 to spark plugs 921, 922, 923, and 924 of the respective cylinders through hightension cords 931, 932, 933, and 934.

Figure 22:
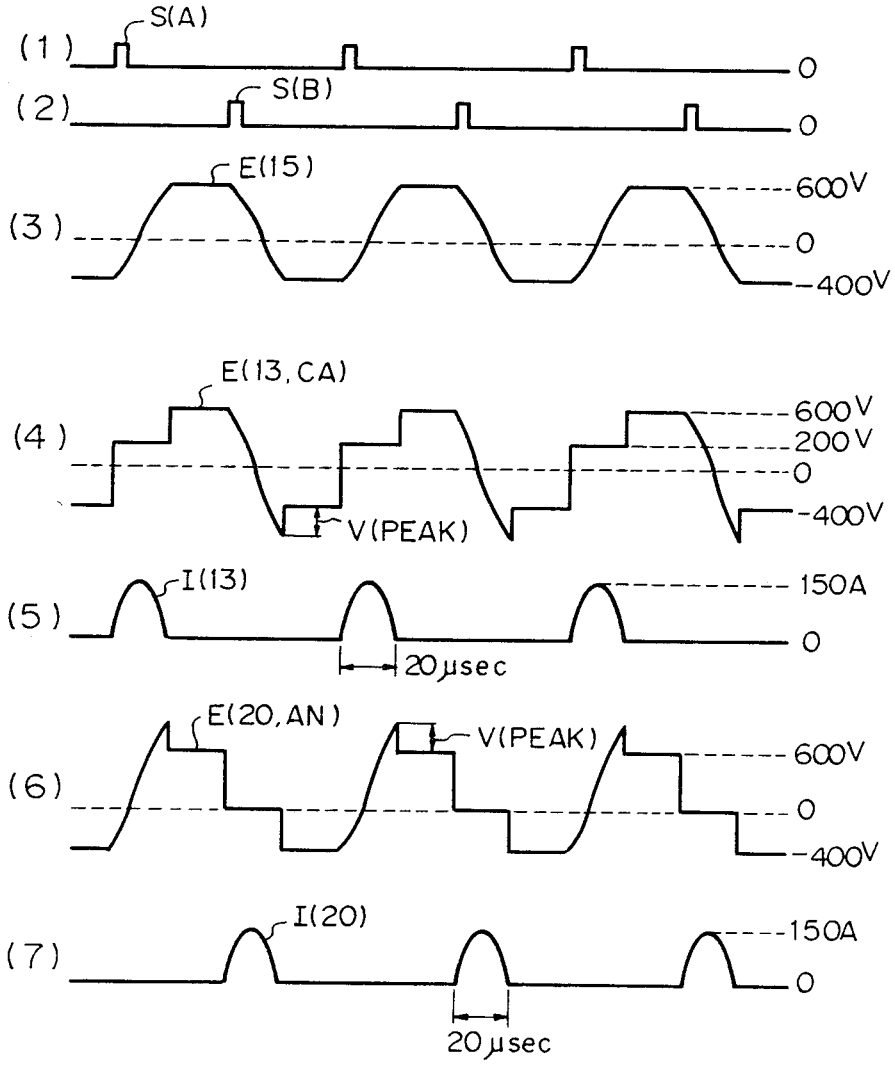
FIG. 22 is a timing chart explaining the mode of operation of a high-voltage generator.

The mode of operation of the high-voltage generating section will be described. FIG. 22 is a timing chart showing the waveforms of the signals at various points in this embodiment. FIG. 22(1) shows the trigger signal S(A); FIG. 22(2) shows the trigger signal S(B); FIG. 22(3) shows a terminal voltage E(15) of a capacitor 15; FIG. 22(4) shows a cathode voltage E(13, CA) of a thyristor 13; FIG. 22(5) shows an ON current I(13) of the thyristor 13; FIG. 22(6) shows an anode voltage E(20, AN) of a thyristor 20; and FIG. 22(7) shows an ON current I(20) of the thyristor 20.

The trigger signal S(A) shown in FIG. 22(1) triggers the thyristor 13 through a pulse transformer 14 and a noise preventing circuit. Similarly, the trigger signal S(B) shown in FIG. 22(2) triggers the thyristor 20 through a pulse transformer 21 and another noise preventing circuit.

When the thyristor 13 is triggered, a current flows to the closed circuit consisting of a capacitor 4, the thyristor 13, the primary coil 161, and the capacitor 15. Since the capacitance of the capacitor 4 is sufficiently greater than of the capacitor 15, the capacitor 4 can be equivalently considered as a power source of a predetermined voltage (200 V). Furthermore, since the resistance of the circuit consisting of the primary coil 161 and the thyristor 13 is sufficiently small, the first closed circuit resonates at a frequency which is determined by a capacitance C (e.g., 2 $\mu$F) of the capacitor 15 and an inductance L (e.g., 50 $\mu$H) of the primary coil 161.

The resonance current flows toward the positive terminal of the capacitor 4, the thyristor 13, the primary coil 161, the capacitor 15, and the ground terminal of the capacitor 4, and has a sinusoidal (positive half cycle) waveform shown in FIG. 22(5). The resonance current has a peak value of about 150 A and an ON time of about 20 μsec. When the resonance current flows in this manner, the voltage applied to the capacitor 15 increases to about 600 V, as shown in FIG. 22(3).

The thyristor 13 is kept ON if $i>0$ and is commutated and turned off if $i \leqq 0$, as shown in FIG. 22(5).

In this manner, since the resonance current flows in the circuit including the primary coil, the capacitor, the switching element, and the DC power source, the thyristor 13 can commutate naturally, and a special commutation circuit need not be incorporated.

When the thyristor 13 is turned off, the voltage stored on the capacitor 15 is about 600 V, which is about three times the 200 V of the DC power source. This is due to the amplification effect of the resonance phemomenon.

Now a case will be considered wherein the thyristor 20 is triggered. When the thyristor 20 is turned on, a closed circuit is formed which consists of the capacitor 15, the second primary coil 162, and the thyristor 20. The charge on the capacitor 15 then flows toward the upper terminal of the capacitor 15, the second primary coil 162, the thyristor 20, and the lower terminal of the capacitor 15, and has a sinusoidal waveform (positive half cycle) as shown in FIG. 22(7). As in the case of the thyristor 13, the current flowing when the thyristor 20 is turned on has a peak value of about 150 A and an ON time of about 20 μsec. The voltage applied to the capacitor 15 decreases from about 600 V to about −400 V, as shown in FIG. 22(3). When the current flowing to the thyristor 20 becomes zero, as shown in FIG. 22(7), the thyristor 20 naturally commutates as in the case of the thyristor 13. Accordingly, a special commutation circuit need not be incorporated.

Thereafter, if the thyristors 13 and 20 are alternately triggered, a current flows alternately to the first and second primary coils 161 and 162.

The first and second primary coils 161 and 162 and the secondary coil 163 have a turn ratio of about 150. Therefore, a voltage 150 times that of the primary coils 161 and 162 is generated in the secondary coil 163.

Theoretically, since the voltage applied to the first and second primary coils 161 and 162 is about 600 V, a high voltage of 90 kV ($=600\ (V)\times 150$) is generated in the secondary coil 163 in accordance with the turn ratio 150. However, in practice, a voltage of about 40 kV is generated in the secondary coil 163 due to loss through the ignition coil 16 and the like. This voltage, however, is sufficiently high for discharge.

The voltage generated in the secondary coil 163 is distributed to the predetermined cylinders by the distributor 9, to be applied to the spark plugs 921, 922, 923, and 924 through the high-tension cords 931, 932, 933, and 934. The discharge at the electrode of the spark plug is grounded to perform spark ignition.

When the discharge path is formed once, the surrounding air is ionized to form an arc discharge. The induction discharge is sustained until the applied voltage becomes lower than the discharge voltage (about 500 V to 1 kV). The discharge time is relatively short (about 2 msec) compared to that of a conventional device. But when this induction discharge ends, the next cycle is started immediately, and thus the discharge can be restarted easily due to the residual ions in the spark gap. Accordingly, the discharge operation can be performed with substantially no interruption. The discharge time can be determined by the ignition timing which is electrically set by the trigger signal generator 7. Therefore, the discharge time can be easily set to a period long enough to allow reliable ignition.

For a time period of about half the ON period of one thyristor, the remaining thyristors are reverseblocked. Therefore, the repeating period of the trigger signals S(A) and S(B) can be shortened. Since a plurality of sparks of extremely short duration can be continuously generated for a suitable period of time, the ignition performance of the internal combustion engine can be improved.

Figure 23:
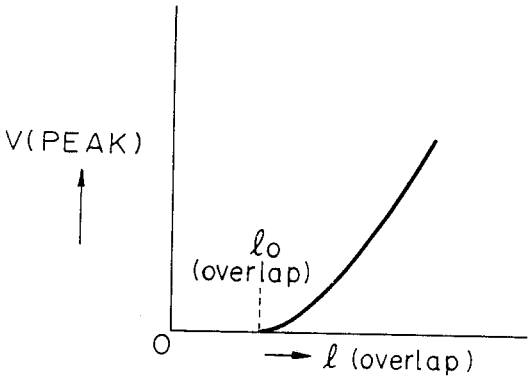
FIG. 23 is a graph showing the peak voltage V of a thyristor anode voltage as a function of the length of an overlapping portion of a primary coil in the ignition coil.

The anode voltage (E(20, AN)) of the thyristor 20 has a peak voltage V(PEAK) when the thyristor 13 is turned off. The peak voltage V(PEAK) is associated with a length l (overlap) of an overlapping portion of the first and second primary coils 161 and 162 of the ignition coil 16, as shown in FIG. 21; i.e., the degree of magnetic coupling between the first and second primary coils 161 and 162. FIG. 23 shows the overlap l as a function of the peak voltage. It can be seen from FIG. 23 that when the length l (overlap) becomes below a predetermined value l0, the peak voltage Vp becomes zero. Therefore, if the length l is set to be l0 (overlap), the forward-blocking voltage of the thyristor 20 can be 600 V or higher, thus decreasing the forward-blocking voltage by the peak value V(PEAK).

The above also applies to the case of the thyristor 13 shown in FIG. 22(4). When the overlap is set to be l0 (overlap), the forward-blocking voltage of the thyristor 13 can be decreased by V(PEAK).

If the length l (overlap) of the overlapping portion shown in FIG. 21 is rendered too small, the magnetic coupling between the primary coils 161 and 162 and the secondary coil 163 is weakened, and the output voltage from the secondary coil 163 is decreased. Therefore, the length l of the overlapping portion should not be rendered smaller than is necessary.

The length of the primary coils 161 and 162 which are strongly magnetically coupled can be suitably set by changing the length l of the overlapping portion of the first and second primary coils 161 and 162 shown in FIG. 21. Then the peak voltage of the voltage applied to the thyristor 13 or 20 can be reduced or can be nullified. Thus thyristors having low forward-blocking voltages can be used, so that the overall device can be rendered inexpensive.

In the device described above, the primary coils 161 and 162 of the ignition coil 16 are inserted between the thyristors 13 and 20. Therefore, even if the thyristors 13 and 20 are simultaneously turned on and the charge on the capacitor 4 is entirely discharged through the thyristors 13 and 20, an abrupt increase in current or the flow of a surge current is prevented by the inductance and resistance of the primary coils 161 and 162. In this manner, any damage to the thyristors or other switching elements ordinarily caused by too great a value of di/dt or the flow of a surge current of the thyristor can be prevented.

Since the capacitor 15 is connected to the intermediate terminal 160 of the primary coils 161 and 162, the rate of change dV/dt of the voltage applied to the thyristors 13 and 20 in the forward direction is determined to be 100 V/μsec or less, by the time constant of the capacitor 15 and the primary coil 162 and that of the capacitor 15 and the primary coil 161. Thus, the rate of change dV/dt can be reduced to a value lower than 100 V/μsec.

Erratic operation due to a high value of the rate of change dV/dt of the voltage applied to the voltage upon operation of one thyristor can therefore be prevented.

The primary coils 161 and 162 are wound in the same direction to generate magnetic fields of the same direction. Therefore, the rate of change dV/dt of the voltage applied to the switching element is reduced, and the switching element can operate safely and reliably.

We claim:

1. An ignition device for an internal combustion engine, comprising:

a DC power source for generating a DC voltage;

an ignition coil having a primary coil and a secondary coil, at least said primary coil being divided into first and second parts by an intermediate tap;

a spark gap connected to said secondary coil;

a capacitor connected to said intermediate tap of said primary coil;

a first switching element for forming a first closed circuit together with the first part of said primary coil, said capacitor and said DC poser source, said capacitor charging through said primary coil first part and a high voltage for ignition being generated across said secondary coil when said first switching element conducts;

a second switching element for forming a second closed circuit together with said second part of said primary coil and said capacitor, said capacitor discharging through said primary coil second part and a high voltage for ignition being generated across said secondary coil when said second switching element conduts; and a signal generating circuit, responsive to an ignition command signal, for generating a plurality of ON signals during a predetermined period of ignition timing so as to alternately turn on said first and second switching elements at predetermined timings during said predetermined period.

2. A device according to claim 1, wherein a circuit having said first switching element, said second switching element, said capacitor, and said ignition coil is commonly arranged for all cylinders of a multi-cylinder internal combustion engine.

3. A device according to claim 1, wherein a circuit having said first switching element, said second switching element, said capacitor, and said ignition coil is arranged for each cylinder of a multi-cylinder internal combustion engine.

4. A device according to claim 1, wherein said first and second parts of said primary coil generate magnetic fields in the same direction.

5. A device according to claim 1, wherein said first and second parts of said primary coil generate magnetic fields in opposite directions.

6. A device according to claim 1, further comprising a voltage abnormality detecting circuit which detects an abnormal voltage when an output voltage from said DC power source becomes below a predetermined voltage and thereupon generates a signal for temporarily stopping operation of said DC power source.

7. A device according to claim 6, wherein said voltage abnormality detecting circuit includes a constant voltage element and a photocoupler element which are connected to an output side of said DC power source.

8. A device according to claim 1, wherein said first and second switching elements respectively comprise thyristors, and said signal generating circuit comprises a transistor for directly driving a gate of each of said thyristors.

9. An ignition device for an internal combustion engine, comprising:

a DC power source for generating a DC voltage;

an ignition coil having first and second primary coils and first and second secondary coils;

a plurality of spark plugs connected to said first and second secondary coils;

a capacitor connected to a primary coil intermediate terminal, one end of each of said first and second primary coils being connected at said intermediate terminal so that said first and second primary coils generate magnetic fields in the same direction upon being energized;

a first switching element for forming a first closed circuit together with said first primary coil, said capacitor, and said DC power source, said capacitor charging through said primary coil and a high ignition voltage being generated across said secondary coils when said first switching element conducts;

a second switching element for forming a second closed circuit together with said primary coil and said capacitor, said capacitor discharging through said second primary coil and a high ignition voltage being generated across said secondary coils when said second switching element conducts; and a signal generating circuit, responsive to an ignition command signal, for generating a plurality of ON signals during a predetermined period of ignition timing so as to alternately turn on said first and second switching elements at predetermined timings during said predetermined period.

10. A device according to claim 9, wherein said first and second primary coils and said first and second secondary coils are wound around a single iron core.

11. A device according to claim 9, wherein said first primary coil and said first secondary coil are wound around a first iron core, and said second primary coil and said second secondary coil are wound around a second iron core.

12. A device according to claim 10, wherein said first and second secondary coils have a secondary coil intermediate terminal connecting one end of each thereof for subtraction of a voltage generated, one spark plug is connected between said secondary coil intermediate terminal and ground, an ignition coil is connected to the other end of each of said first and second secondary coils to which said secondary coil intermediate terminal is not connected, whereby the single ignition coil causes the three spark plugs to discharge.

13. An ignition device for an internal combustion engine, comprising:

a DC source for generating a DC voltage;

an ignition coil having first and second primary coils and a secondary coil, said first and second primary coils partially overlapping each other to be magnetically strongly coupled;

a spark plug connected to said secondary coil;

a capacitor connected to a primary coil intermediate terminal, one end of each of said first and second primary coils being connected at said intermediate terminal so that said first and second primary coils generate magnetic fields in the same direction upon being energized;

a first switching element for forming a first closed circuit together with said first primary coil and said DC power source, said capacitor charging through said primary coil and a high ignition voltage being generated across said secondary coil when said first switching element conducts;

a second switching element for forming a second closed circuit together with said second primary coil and said capacitor, said capacitor discharging through said secondary coil and a high ignition voltage being generated across said secondary coil when said second switching element conducts; and a signal generator, responsive to an ignition command signal, for generating a plurality of ON signals during a predetermined period of ignition timing so as to alternately turn on said first and second switching elements at predetermined timings during said predetermined period.

14. A device according to claim 13, wherein said first and second primary coils are wound to partially overlap each other.

15. A device according to claim 1 wherein said DC power source includes a power source capacitor having a capacitance substantially greater than that of said capacitor connected to said intermediate tap of said primary coil and a charging power source for charging said power source capacitance.

16. A ignition device for an internal combustion engine, comprising:

a DC power source for generating a DC voltage;

an ignition coil having a primary coil and a secondary coil, at least said primary coil being divided into first and second parts by an intermediate tap;

a spark gap connected to said secondary coil;

a capacitor connected to said intermediate tap of said primary coil;

a first switching element for forming a first closed circuit together with the first part of said primary coil, said capacitor and said DC power source, said capacitor charging through said primary coil first part and a high voltage for ignition being generated across said secondary coil when said first switching element conducts;

a second switching element, commonly arranged for all cylinders of said internal combustion engine, for forming a second closed circuit together with said part of said primary coil and said capacitor, said capacitor discharging through said primary coil second part and a high voltage for ignition being generated across said secondary coil when said second switching element conducts;

said device further including a rectifying element for distributing voltage to a spark gap associated with each of said cylinder; and a singal generating circuit, responsive to an ignition command signal, for generating a plurality of ON signals during a predetermined period of ignition timing so as to alternately turn on said first and second switching elements at predetermined timings during said predetermined period.

* * * * *

UNITED STATES PATENT AND TRADEMARK OFFICE

CERTIFICATE OF CORRECTION

PATENT NO. : 4,562,823

DATED : January 7, 1986

INVENTOR(S) : M. MORITUGU et al

It is certified that error appears in the above-identified patent and that said Letters Patent is hereby corrected as shown below:

Claim 1, column 27, line 20, "poser" should read--power--

Claim 16, column 30, line 16, after "said" should read --second--

Signed and Sealed this

*Fifteenth* Day of *July 1986*

[SEAL]

*Attest:*

*Attesting Officer*

DONALD J. QUIGG

*Commissioner of Patents and Trademarks*